US011591867B2

(12) United States Patent
Beaton

(10) Patent No.: US 11,591,867 B2
(45) Date of Patent: Feb. 28, 2023

(54) METHOD AND APPARATUS FOR REMOVING DEBRIS FROM A DRILL HOLE DURING DRILLING

(71) Applicant: L. Curtis Beaton, Waltham, MA (US)

(72) Inventor: L. Curtis Beaton, Waltham, MA (US)

( * ) Notice: Subject to any disclaimer, the term of this patent is extended or adjusted under 35 U.S.C. 154(b) by 0 days.

(21) Appl. No.: 17/180,044

(22) Filed: Feb. 19, 2021

(65) Prior Publication Data

US 2021/0172317 A1 Jun. 10, 2021

Related U.S. Application Data

(63) Continuation-in-part of application No. 16/119,148, filed on Aug. 31, 2018, now Pat. No. 11,002,134, which is a continuation of application No. 15/443,174, filed on Feb. 27, 2017, now Pat. No. 10,087,755.

(60) Provisional application No. 62/978,493, filed on Feb. 19, 2020, provisional application No. 62/300,168, filed on Feb. 26, 2016.

(51) Int. Cl.

| | |
|---|---|
| ***E21B 21/06*** | (2006.01) |
| ***E21B 21/12*** | (2006.01) |
| ***E21B 10/38*** | (2006.01) |
| *E21C 37/02* | (2006.01) |
| *E21B 7/02* | (2006.01) |
| *E21C 37/04* | (2006.01) |

(52) U.S. Cl.

CPC ..... *E21B 21/065* (2013.01); *E21B 10/38* (2013.01); *E21B 21/12* (2013.01); *E21B 7/027* (2013.01); *E21C 37/02* (2013.01); *E21C 37/04* (2013.01)

(58) Field of Classification Search

CPC ..... E21C 37/02; E21C 37/04; E21B 7/027; E21B 10/38; E21B 10/602; E21B 21/065; E21B 21/07; E21B 21/12; E21B 21/012; E21B 21/063; E21B 21/066; E21B 21/011

USPC ..... 175/212

See application file for complete search history.

(56) References Cited

U.S. PATENT DOCUMENTS

| | | | | |
|---|---|---|---|---|
| 2,701,122 A * | 2/1955 | Grable | ..... | E21B 21/12 175/69 |
| 3,655,001 A * | 4/1972 | Hoffman | ..... | E21B 21/12 175/215 |
| 4,683,944 A * | 8/1987 | Curlett | ..... | E21B 21/08 175/215 |

(Continued)

FOREIGN PATENT DOCUMENTS

WO WO-2018112540 A1 * 6/2018

*Primary Examiner* — Abby J Flynn
*Assistant Examiner* — Michael A Goodwin
(74) *Attorney, Agent, or Firm* — Pandiscio & Pandiscio

(57) ABSTRACT

A system for removing debris from a drill hole, the system comprising a drill rod, a first lumen extending through the drill rod, and a second lumen extending parallel to the first lumen; a drill bit for mounting to the drill rod, the drill bit being configured to form the drill hole; at least one air channel extending between the proximal end of the drill bit and the distal end of the drill bit, the at least one air channel being configured to be fluidically connected to the first lumen of the drill rod; at least one vacuum channel extending between the proximal end of the drill bit and the distal end of the drill bit, the at least one vacuum channel being configured to be fluidically connected to the second lumen of the drill rod; and a container fluidically connected to the second lumen of the drill rod.

11 Claims, 20 Drawing Sheets

(56) References Cited

U.S. PATENT DOCUMENTS

| | | | | |
|---|---|---|---|---|
| 5,975,219 | A * | 11/1999 | Sprehe | E21B 21/07 175/48 |
| 2006/0037783 | A1* | 2/2006 | Biscay | B23Q 11/006 175/57 |
| 2016/0053550 | A1* | 2/2016 | Wilson | E21B 21/08 175/215 |

* cited by examiner

METHOD AND APPARATUS FOR REMOVING DEBRIS FROM A DRILL HOLE DURING DRILLING

REFERENCE TO PENDING PRIOR PATENT APPLICATIONS

This patent application:

(i) is a continuation-in-part of prior U.S. patent application Ser. No. 16/119,148, filed Aug. 31, 2018 by L. Curtis Beaton for METHOD AND APPARATUS FOR SPLITTING OR CLEAVING ROCK, which patent application:

(A) is a continuation of prior U.S. patent application Ser. No. 15/443,174, filed Feb. 27, 2017 by L. Curtis Beaton for METHOD AND APPARATUS FOR SPLITTING OR CLEAVING ROCK, which patent application in turn:

(1) claims benefit of prior U.S. Provisional Patent Application Ser. No. 62/300,168, filed Feb. 26, 2016 by L. Curtis Beaton for METHOD AND APPARATUS FOR SPLITTING OR CLEAVING ROCK OR CONCRETE; and (ii) claims benefit of prior U.S. Provisional Patent Application Ser. No. 62/978,493, filed Feb. 19, 2020 by L. Curtis Beaton for METHOD AND APPARATUS FOR REMOVING DEBRIS FROM A DRILL HOLE DURING DRILLING.

The four (4) above-identified patent applications are hereby incorporated herein by reference.

FIELD OF THE INVENTION

This invention relates to construction and excavation apparatus and methods in general, and more particularly to novel methods and apparatus for splitting or cleaving rock, and/or for removing debris from a drill hole during drilling.

BACKGROUND OF THE INVENTION

Mankind has had reason to split, cleave or otherwise "break up" rock for centuries, if not millennia. For example, rock has been broken up to make way for human infrastructure (e.g., roads, canals, railways, etc.) and/or to provide materiel to build infrastructure (e.g., roadway surfaces, aqueducts, bridges, etc.).

Methods and apparatus for breaking up (e.g., splitting, cleaving, etc.) rock have progressed from simple manual processes (e.g., dropping rocks from a high place so that the rocks are broken on impact), to the use of simple tools (e.g., hammers, wedges, etc.) to split rock, to the use of sophisticated tools (e.g., explosives and/or hydraulic rock splitting devices).

Splitting or cleaving rock is necessary and/or useful in many different fields of endeavor, and is of particular importance and utility in the modern construction industry. In many geographical areas, the excavation of rock for the construction of a foundation for a building or other structure, excavation of rock for utilities, excavation of rock for roadways, etc., requires either the complete removal, or at least augmentation, of naturally-occurring rock formations (or earlier human-built foundations) in order to allow for the construction of a foundation for a building or some other structure.

In some locations, such as in or near less densely populated areas, the removal of rock may be accomplished through the use of explosives, in accordance with various methods known in the art. In more densely populated areas, however, the use of explosives may be undesirable for many reasons, including but not limited to the dangers associated with the transformation of rock fragments into projectiles by the explosive blast, the noise produced by the explosions, and the generation of surface and subsurface vibrations, shockwaves and the like by the explosives. These vibrations and shockwaves can, among other things, damage and/or weaken nearby structures. In addition, the use of explosives in geological areas where fault lines are present may present additional issues, such as enhanced transmission of shockwaves, vibrations and sound along the fault line.

In addition to the foregoing, there may also be legal prohibitions and/or significant restrictions on the use of explosives in a given area. Such restrictions and/or prohibitions can be quite common in densely or even moderately densely populated areas. In addition to the foregoing, applicable laws and regulations frequently prescribe strict requirements for the proper storage of explosives and require the use of specially trained personnel in connection with their use. Accordingly, the cost of procuring, storing and using explosives for breaking and/or removing rock can be quite high.

Perhaps in part as a result of the foregoing considerations associated with the use of explosives to remove or augment rock (particularly in and/or near populated areas), other methods and apparatus for removing rock have been developed.

Specifically, drills and hydraulic rock splitting devices have been developed for use in splitting rock. Such devices are typically hand-held, being maneuvered into place by a workman and then used in a sequential fashion to split rock.

In use, a hand-held drill is typically first used to bore a hole in a rock, and then a hand-held rock splitter apparatus (e.g., a wedge combined with a tether for receiving the wedge) is placed into the hole and used to split the rock (i.e., the wedge is driven into the tether so as to cause the tether to bear against the side walls of the hole and split the rock). Such apparatus are generally effective, however, not very efficient. Since the hand-held drill and the hand-held splitter apparatus are both typically quite heavy and cumbersome, they require personnel to position and operate them effectively. Moreover, with such a sequential rock splitting process utilizing two different hand-held tools, several discrete steps need to be carried out in order to split the rock. First, the workman needs to bring the hand-held drill to the site that the hole is to be drilled. Then the workman needs to drill the hole into the rock using the hand-held drill in order to form a drill hole in the rock for receiving the splitting apparatus. After the drill hole is formed in the rock, the workman needs to remove the drill from the drill hole and maneuver the splitting apparatus over the hole. Finally, the splitting apparatus (i.e., the tether and the wedge) is placed into the hole and used to split the rock. It will be appreciated that the foregoing procedure is significantly time consuming, requiring a larger workforce and/or additional heavy equipment (i.e., to transport the drill and/or splitting apparatus around the worksite), thereby making the rock splitting project both more time consuming and more expensive.

Thus, there is a need for a new and improved method and apparatus for splitting or cleaving rock which combines the drilling apparatus for drilling a hole in the rock in order to provide a drill hole for receiving the wedge, with the splitting apparatus (i.e., the wedge) for splitting the rock, wherein the combined apparatus can be easily maneuvered into place and used to split a rock without requiring the movement of cumbersome, heavy hand-held tools or a large workforce.

In addition to the foregoing, it has also been recognized that the drilling of a hole in a rock (e.g., to provide a drill hole for receiving a wedge) can generate a significant amount of debris, e.g., in the form of rock chips, ground rock, dust, etc., as the hole (i.e., the "drill hole") is drilled into the rock. Typically, such debris is removed manually from the drill hole (e.g., by sweeping the debris away from the surface opening of the drill hole, by removing the drill from the hole and cleaning out debris by hand, etc.). In some instances, hollow drill shafts and bits are utilized in order to pass pressurized air from an external source (e.g., a compressor) through a drill shaft and into the drill hole, whereby to force debris up and out of the drill hole in the rock under pressure so that it may be cleared away from the surface opening of the drill hole.

However, such approaches for clearing debris from the drill hole suffer from at least two significant drawbacks. First, the debris must be manually collected and taken away, and second, when the rock is pulverized to fine material (e.g., dust), workers are exposed to aerosolized dust and debris which may exacerbate or cause adverse health conditions (e.g., due to being drawn into the lungs) or require additional equipment to work with (e.g., respirators).

Thus, there is also a need for a new and improved method and apparatus for cleanly and efficiently removing debris from a drill hole during drilling without requiring removal of the drill from the drill hole during drilling.

SUMMARY OF THE INVENTION

The present invention provides a new and improved apparatus and method for spitting or cleaving rock or concrete, and a new and improved method and apparatus for cleanly and efficiently removing debris from a drill hole during drilling without requiring removal of the drill from the drill hole.

More particularly, the present invention comprises the provision and use of novel rock splitting apparatus which combines a drilling apparatus for drilling a hole in the rock in order to provide a drill hole for receiving the splitting apparatus (i.e., a wedge and a tether for receiving the wedge), with the splitting apparatus (i.e., the wedge and the tether) for splitting the rock, wherein the combined apparatus can be mounted to an excavator.

In one preferred form of the invention, there is provided apparatus for splitting rock, said apparatus comprising:

a housing;

a drill assembly mounted to the housing and configured to move longitudinally relative to the housing, said drill assembly comprising a shaft having a proximal end and a distal end, a drive element for selectively rotating said shaft and a drill bit mounted to said distal end of said shaft for drilling a hole into rock;

a splitter assembly mounted to the housing and configured to move longitudinally relative to the housing, said splitter assembly comprising a tether and a wedge, said tether and said wedge being configured to be moved independently relative to one another;

wherein said wedge comprises a proximal end and a distal end, said proximal end of said wedge being wider than said distal end of said wedge;

wherein said tether comprises a radially-reduced profile when said wedge is disposed proximal to said tether, and wherein said tether comprises a radially-expanded profile after said wedge is moved distally relative to said tether.

In another preferred form of the invention, there is provided a method for splitting rock, said method comprising:

providing apparatus comprising:

a housing;

a drill assembly mounted to the housing and configured to move longitudinally relative to the housing, said drill assembly comprising a shaft having a proximal end and a distal end, a drive element for selectively rotating said shaft and a drill bit mounted to said distal end of said shaft for drilling a hole into rock;

a splitter assembly mounted to the housing and configured to move longitudinally relative to the housing, said splitter assembly comprising a tether and a wedge, said tether and said wedge being configured to be moved independently relative to one another;

wherein said wedge comprises a proximal end, a distal end and a bore extending between said proximal end of said wedge and said distal end of said wedge, wherein said bore is sized to receive said shaft of said drill assembly;

wherein said drill assembly is disposed proximal to said splitter assembly such that said shaft of said drill assembly passes through said bore of said wedge and through said tether;

wherein said tether comprises a radially-reduced profile when said wedge is disposed proximal to said tether, and wherein said tether comprises a radially-expanded profile after said wedge is moved distally relative to said tether;

rotating said shaft of said drill assembly and moving said drill assembly distally so as to drill a hole in a rock with said drill bit;

moving said tether distally into the hole formed in the rock with said drill assembly;

driving said wedge distally into said tether such that said tether exhibits a radially-expanded profile and bears against the walls of the hole formed in the rock, whereby to split the rock.

In another preferred form of the invention, there is provided apparatus for moving a rod, said apparatus comprising:

A central tube and a hydraulic chamber disposed coaxially about said central tube and fluidically isolated therefrom, said hydraulic chamber having a proximal end, a distal end and a side wall extending therebetween;

a proximal cap for covering the proximal end of said hydraulic chamber and a distal cap for covering the distal end of said hydraulic chamber;

a piston movably disposed within said hydraulic chamber coaxial with said central tube, said piston comprising a proximal surface and a distal surface, said piston being configured so as to fluidically divide said hydraulic chamber into an upper chamber located proximal to said proximal surface of said piston and a lower chamber located distal to said distal surface of said piston;

at least one piston rod extending distally from said distal surface of said piston;

a first port for fluidically connecting said upper chamber to a hydraulic fluid source and a second port for fluidically connecting said lower chamber to a hydraulic fluid source;

wherein introduction of hydraulic fluid into said upper chamber via said first port causes said piston to move distally, whereby to drive said rod distally, and further wherein introduction of hydraulic fluid into said lower chamber via said second port causes said piston to move proximally, whereby to drive said rod proximally.

In another preferred form of the invention, there is provided a system for removing debris from a drill hole, said system comprising:

a drill system comprising:

a drill rod comprising a proximal end, a distal end a first lumen extending between said proximal end and said distal end, and a second lumen extending parallel to said first lumen, said first lumen being fluidically-isolated from said second lumen;

a drill bit, said drill bit comprising:

a proximal end for mounting to said distal end of said drill rod;

a distal end configured to drill into a material so as to form the drill hole;

at least one air channel extending between said proximal end of said drill bit and said distal end of said drill bit, said at least one air channel being configured to be fluidically connected to said first lumen of said drill rod when said dual channel drill bit is mounted to said drill rod;

at least one vacuum channel extending between said proximal end of said drill bit and said distal end of said drill bit, said at least one vacuum channel being configured to be fluidically connected to said second lumen of said drill rod when said drill bit is mounted to said drill rod;

a container fluidically connected to said second lumen of said drill rod;

a compressor, said compressor being fluidically connected to said first lumen of said drill rod and fluidically connected to said container;

wherein said compressor (i) pumps pressurized air through said first lumen of said drill rod such that said pressurized air passes through said at least one air channel of said drill bit and exits said distal end of said drill bit into the drill hole, and (ii) pumps air out of said container so as to generate a vacuum within said container, which vacuum is fluidically connected to said second lumen of said drill rod and hence to said at least one vacuum channel of said drill bit, such that pressurized air exiting said at least one air channel into the hole and debris in the hole enters said at least one vacuum channel, passes through said second lumen of said drill rod and into said container, such that the debris is collected in said container.

In another preferred form of the invention, there is provided a method for removing debris from a drill hole, said method comprising:

providing a drill system comprising:

a drill rod comprising a proximal end, a distal end a first lumen extending between said proximal end and said distal end, and a second lumen extending parallel to said first lumen, said first lumen being fluidically-isolated from said second lumen;

a drill bit, said drill bit comprising:

a proximal end for mounting to said distal end of said drill rod;

a distal end configured to drill into a material so as to form the drill hole;

at least one air channel extending between said proximal end of said drill bit and said distal end of said drill bit, said at least one air channel being configured to be fluidically connected to said first lumen of said drill rod when said dual channel drill bit is mounted to said drill rod;

at least one vacuum channel extending between said proximal end of said drill bit and said distal end of said drill bit, said at least one vacuum channel being configured to be fluidically connected to said second lumen of said drill rod when said drill bit is mounted to said drill rod;

a container fluidically connected to said second lumen of said drill rod;

a compressor, said compressor being fluidically connected to said first lumen of said drill rod and fluidically connected to said container;

wherein said compressor (i) pumps pressurized air through said first lumen of said drill rod such that said pressurized air passes through said at least one air channel of said drill bit and exits said distal end of said drill bit into the drill hole, and (ii) pumps air out of said container so as to generate a vacuum within said container, which vacuum is fluidically connected to said second lumen of said drill rod and hence to said at least one vacuum channel of said drill bit, such that pressurized air exiting said at least one air channel into the hole and debris in the hole enters said at least one vacuum channel, passes through said second lumen of said drill rod and into said container, such that the debris is collected in said container;

rotating said drill bit so as to form a drill hole in a material; and passing pressurized air through said at least one air channel of said drill bit into the drill hole while simultaneously applying vacuum to said at least one vacuum channel so as to draw debris into said second lumen of said drill rod and into said container.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

Figure 1:
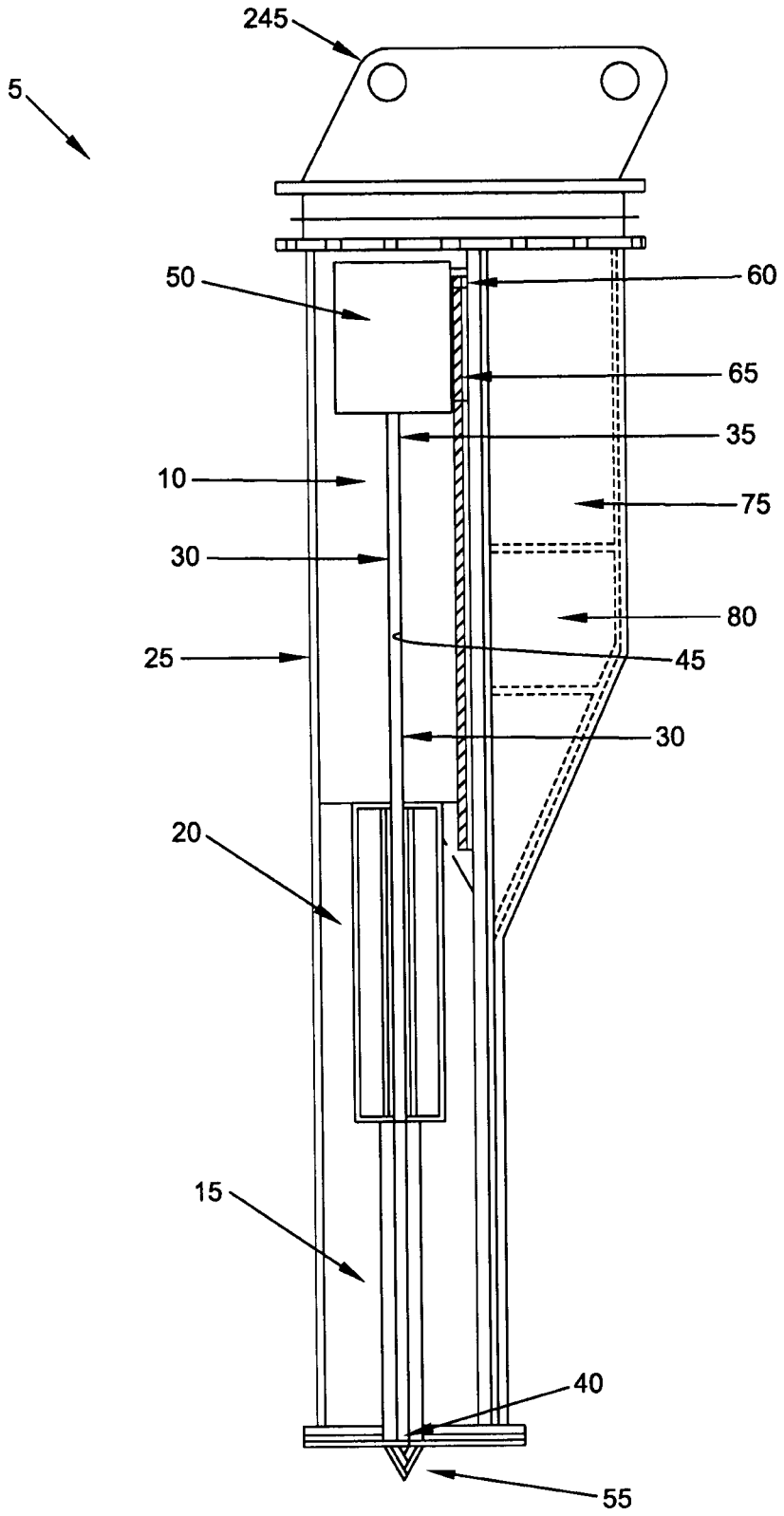
FIG. 1 is a schematic view of a novel rock splitting apparatus formed in accordance with the present invention.

The present invention provides a new and improved apparatus and method for spitting or cleaving rock or concrete and/or a new and improved method and apparatus for cleanly and efficiently removing debris from a drill hole during drilling without requiring removal of the drill from the drill hole during drilling.

Novel Apparatus for Splitting Rock

More particularly, the present invention comprises the provision and use of novel rock splitting apparatus which combines a drilling apparatus for drilling a hole in the rock in order to provide a drill hole for receiving the splitting apparatus (i.e., a wedge and a tether for receiving the wedge), with the splitting apparatus (i.e., the wedge and the tether) for splitting the rock, wherein the combined apparatus can be mounted to an excavator.

As used herein, the term "proximal" refers to the end of the novel rock splitting apparatus which is mounted to the excavator, and the term "distal" refers to the end of the novel rock splitting apparatus which is closest to the rock that is to be split. Put another way, the drill hole that is drilled into the rock that is to be split is drilled in the distal direction, i.e., away from the novel rock splitting apparatus. In addition, as used herein, the term "rock" refers to any naturally-occurring or non-naturally occurring formation that may be found at a worksite, including but not limited to natural rock formations such as shale, marble, granite, ledge, etc., and also including but not limited to non-natural formations such as concrete, cement, gunnite, etc.

Looking first at FIG. 1, there is shown a novel rock splitting apparatus 5 which generally comprises a drill assembly 10, a splitter assembly 15 and a hydraulic ram 20 for selectively advancing/retracting elements of splitter assembly 15, as will hereinafter be discussed in further detail. A housing 25 is disposed over drill assembly 10, splitter assembly 15 and hydraulic ram 20 for protecting the components of novel rock splitting apparatus 5 and for providing a mounting point for different elements of novel rock splitting apparatus 5, as will hereinafter be discussed in further detail.

Drill Assembly 10

Still looking at FIG. 1, drill assembly 10 generally comprises a hollow drill shaft 30 having a proximal end 35, a distal end 40 and a bore 45 extending therebetween. Proximal end 35 of hollow drill shaft 30 is mounted to a drill drive element 50 configured to selectively rotate hollow drill shaft 30 and/or advance/retract hollow drill shaft 30 longitudinally relative to housing 25, as will hereinafter be discussed in further detail. A drill bit 55 (FIG. 2) is mounted to distal end 40 of hollow drill shaft 30 and is configured for drilling into rock, as will hereinafter be discussed in further detail. Although drill bit 55 is shown in FIG. 1 as extending distally out of housing 25, it should be appreciated that drill bit 55 may be retracted proximally into housing 25 so as to protect drill bit 55 from damage.

Figure 3:
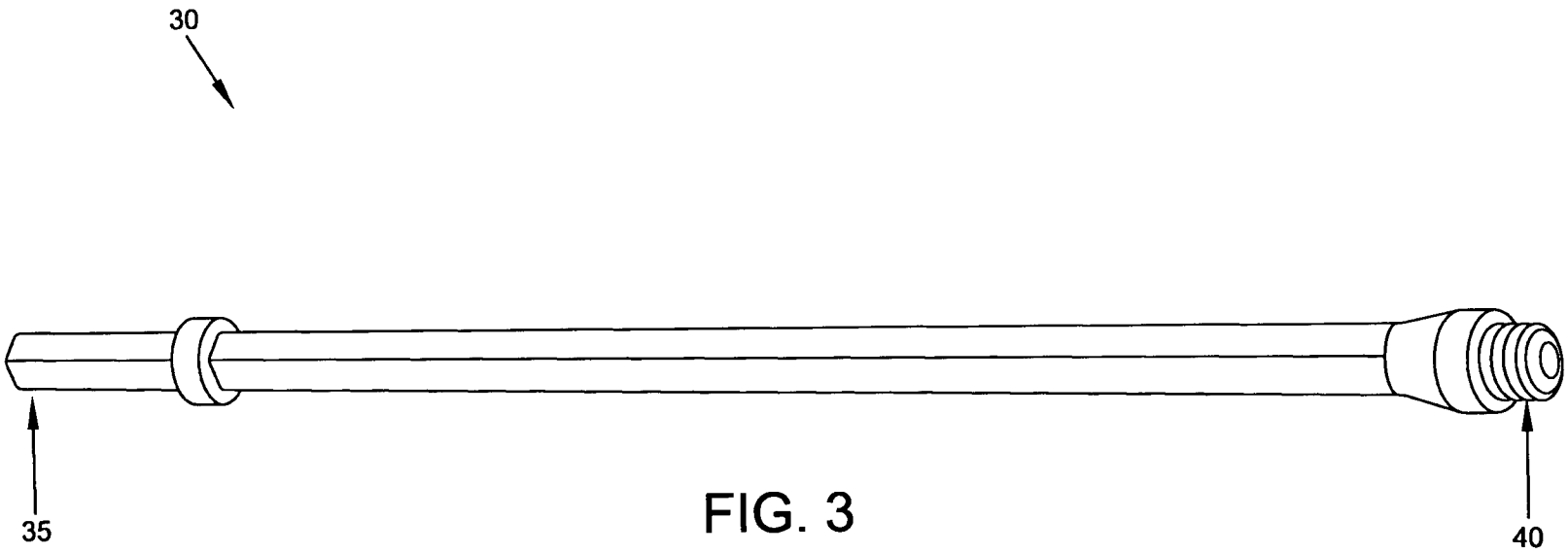
FIG. 3 is a schematic view of a hollow drill shaft configured for use with the novel rock splitting apparatus of FIG. 1.
Figure 4A:
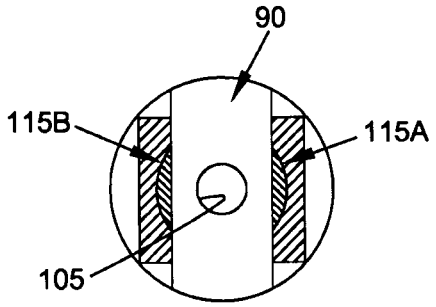
FIGS. 4A, 4B, 4C and 4D are schematic cross-sectional views of the novel splitter assembly shown in FIG. 4.
Figure 4B:
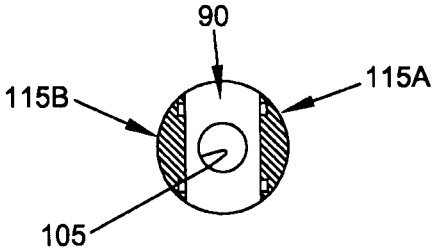
Figure 4C:
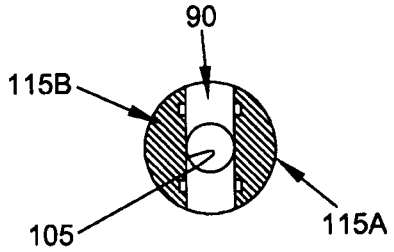
Figure 4D:
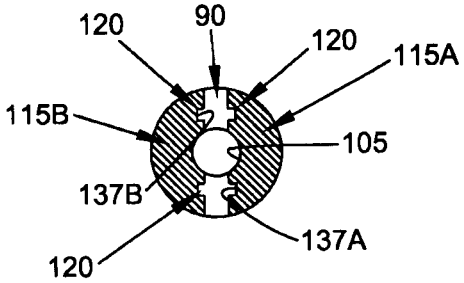
Figure 4:
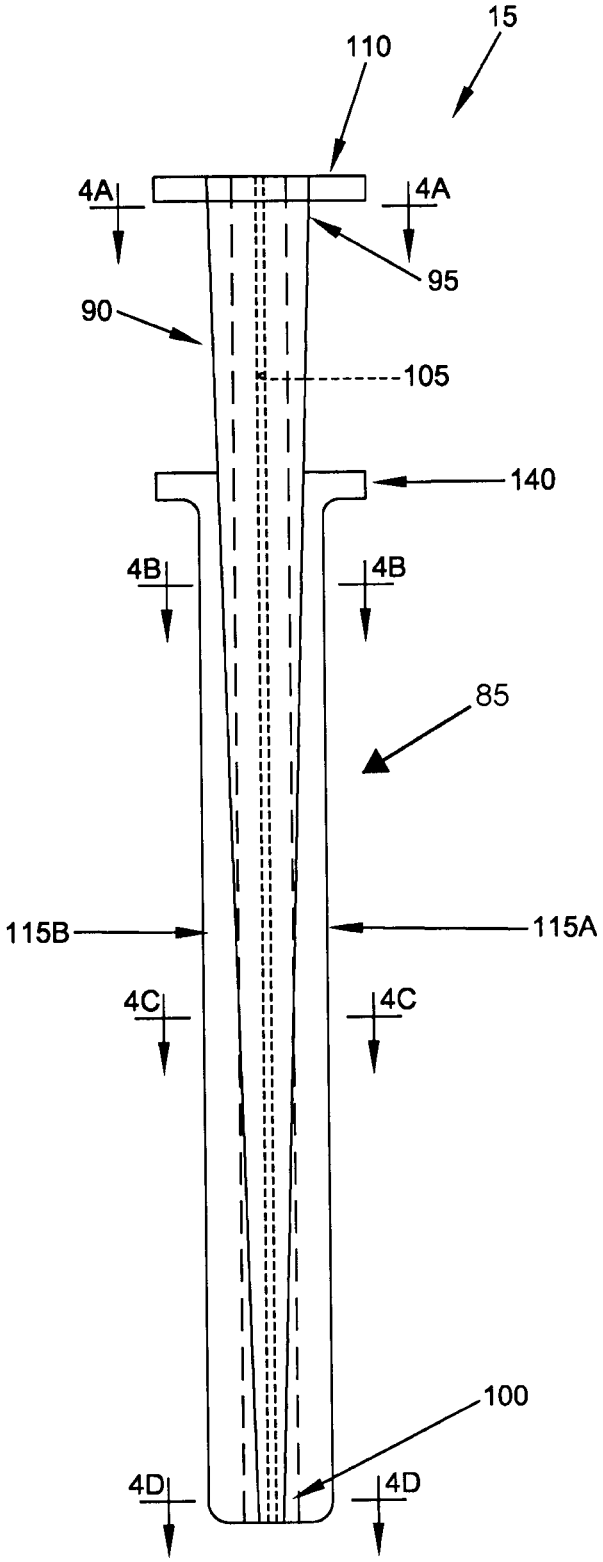
FIG. 4 is a schematic view of a novel splitter assembly formed in accordance with the present invention.
Figure 5:
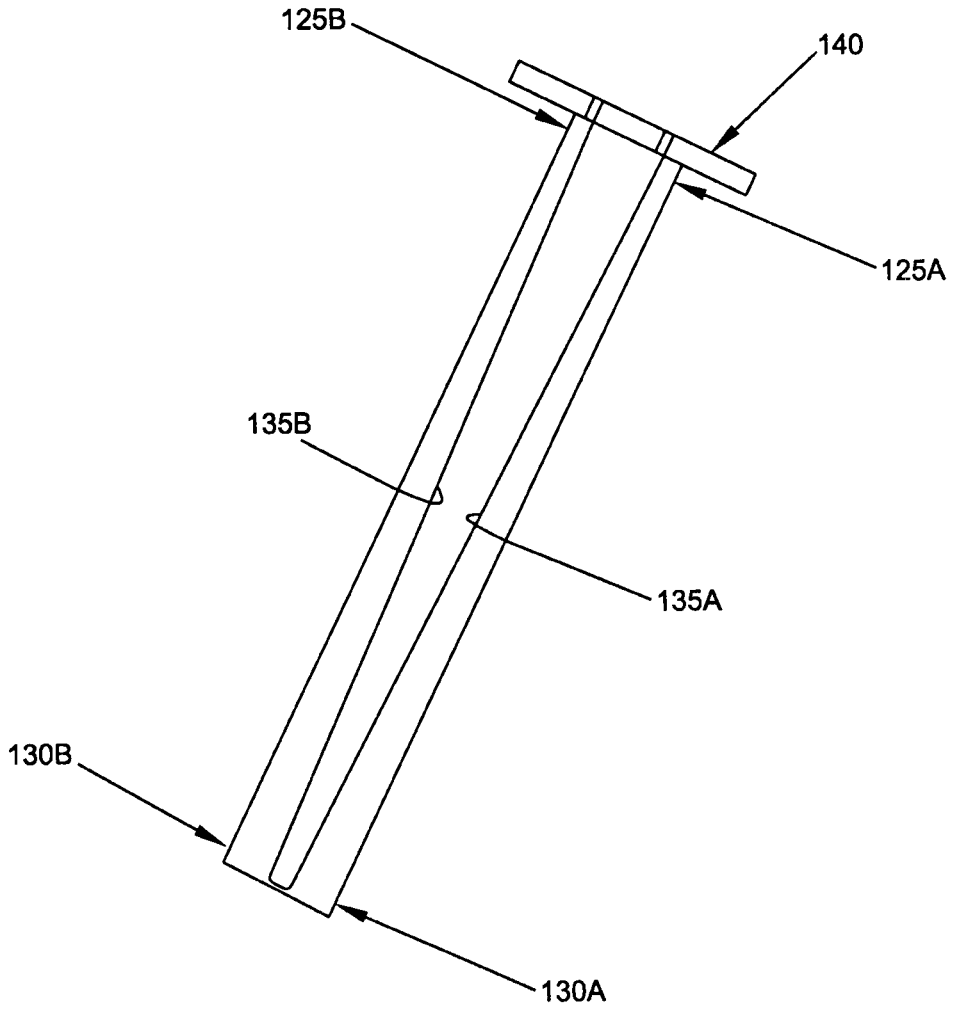
FIG. 5 is a schematic view showing further details of the novel splitter assembly of FIG. 4.

Hollow drill shaft 30 preferably comprises a shaft (e.g., of the sort made by Ingersoll-Rand of Davidson, N.C.) having sufficient rigidity and column strength to be rotated at high speed and simultaneously advanced into rock in order to form a hole in the rock. See FIG. 3. Hollow drill shaft 30 is configured to pass through hydraulic ram 20 and splitter assembly 15, and may be selectively advanced/retracted relative to the distal end of rock splitting apparatus 5, as will hereinafter be discussed in further detail.

Drill drive element 50 is used to selectively rotate hollow drill shaft 30 (and hence, drill bit 55 mounted to distal end 40 of hollow drive shaft 30) and is configured to be selectively moved longitudinally (i.e., distally or proximally) within housing 25 so as to selectively advance or retract drill bit 55 (i.e., as is required during drilling). In one preferred form of the present invention, drill drive element 50 comprises a threaded receiver 60 for threadingly receiving a screw drive 65. In this form of the invention, when screw drive 65 is rotated (e.g., by a motor, not shown), drill drive element 50 (and hence, hollow drill shaft 30 and drill bit 55 mounted thereto) are selectively advanced/retracted (i.e., distally/proximally) along the longitudinal axis of rock splitting apparatus 5, whereby to facilitate drilling into rock or retraction of drill bit 55 and hollow drill shaft 30 from a hole drilled in rock. The direction of longitudinal movement of drill drive element 50 relative to housing 25 may be controlled by changing the direction of rotation of screw drive 65. By way of example but not limitation, screw drive 65 may be configured such that clockwise rotation of screw drive 65 causes drill drive element 50 (and hence, hollow drill shaft 30 and drill bit 55) to move distally, and screw drive 65 may be configured such that counterclockwise rotation of screw drive 65 causes drill drive element 50 (and hence, hollow drill shaft 30 and drill bit 55) to move proximally.

It should be noted that other means for advancing/retracting drill assembly 10 are also within the scope of the invention, including, but not limited to, a chain drive, a hydraulic piston assembly, etc. Still other ways of advancing/retracting drill assembly 10 will be apparent to those skilled in the art in view of the present disclosure.

Drill bit 55 is mounted to distal end 40 of hollow drill shaft 30 and is configured to have a diameter slightly greater than the diameter of the distal end of splitter assembly 15, as will hereinafter be discussed in further detail. By way of example but not limitation, drill bit 55 may comprise a carbide tipped drill bit of the sort manufactured by Ingersoll-Rand of Davidson, N.C.

Figure 2:
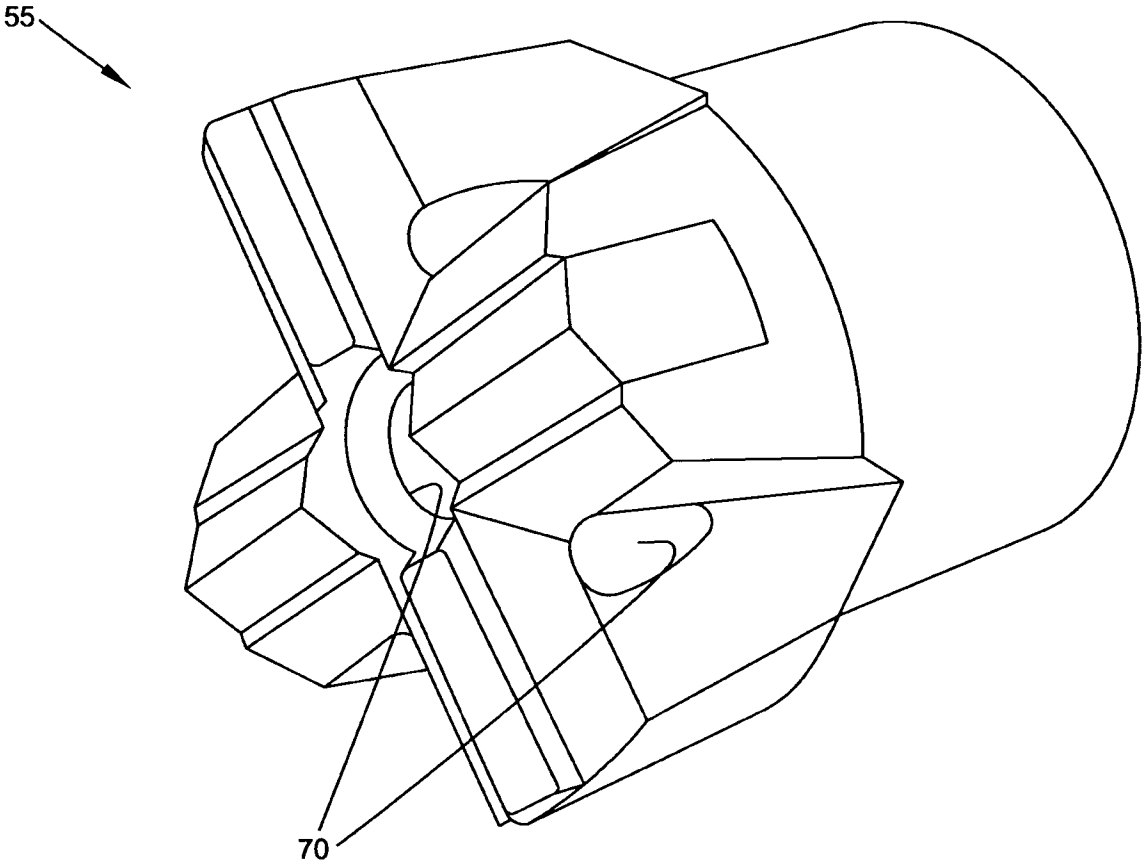
FIG. 2 is a schematic view of a drill bit which configured for use with the novel rock splitting apparatus of FIG. 1.

In a preferred form of the present invention, and looking now at FIG. 2, drill bit 55 comprises one or more openings 70 which are in fluid communication with bore 45 of hollow drill shaft 30. In one preferred form of the invention, novel rock splitting apparatus 5 comprises an air tank 75 for holding compressed air supplied by an air compressor 80 (see FIG. 1). Air tank 75 is fluidically connected to proximal end 35 of hollow drill shaft 30 (e.g., via flexible tubing, not shown) and is in fluid communication with bore 45 of hollow drill shaft 30. As a result, highly-compressed air can be passed down bore 45 of hollow shaft 30 and out one or more openings 70 in drill bit 55 at the interface between drill bit 55 and the rock that is being drilled. This highly-compressed air can be used during drilling to force debris up and out of the drill hole behind the drill bit so as to clear out the drill hole. Alternatively, a vacuum source (not shown)

may be fluidically connected to the proximal end of hollow drill shaft 30 and used to "suck" debris out of the drill hole (i.e., through opening(s) 70 of drill bit 55 and up through bore 45 of hollow drill shaft 30).

Splitter Assembly 15

Looking now at FIGS. 4, 4A, 4B, 4C, 4D and 5, splitter assembly 15 generally comprises a tether 85 and a wedge 90 for slidably engaging to tether 85, with wedge 90 being sized so as to radially expand tether 85 when moved distally relative to tether 85, as will hereinafter be discussed.

More particularly, wedge 90 comprises a proximal end 95, a distal end 100 and a bore 105 extending therebetween, with wedge 90 being tapered from its proximal end to its distal end such that proximal end 95 is significantly wider than distal end 100. Wedge 90 also comprises a wedge plate 110 for mounting wedge 90 to hydraulic ram 20, as will hereinafter be discussed in further detail.

Bore 105 of wedge 90 is sized to slidably receive hollow drill shaft 30 of drill assembly 10. Wedge plate 110 comprises a central opening 112 (FIG. 9) which is sized to receive hollow drill shaft 30 of drill assembly 10. As a result of this construction, hollow drill shaft 30 can pass through central opening 112 of wedge plate 110 and through bore 100 of wedge 90 so as to project distally beyond distal end 100 of wedge 90.

Tether 85 comprises a first tether element 115A and a second tether element 115B which are preferably slidably mounted to wedge 90 proximal to distal end 100 of wedge 90. In a preferred form of the invention, first tether element 115A and second tether element 115B are slidably mounted to wedge 90 via a plurality of dovetail sliders 120 (see FIG. 4D). Tether elements 115A, 115B each comprise a proximal end 125A, 125B and a distal end 130A, 130B, respectively. Tether elements 115A, 115B are tapered, such that distal ends 130A, 130B are thicker than proximal ends 125A, 125B. Thether elements 115A, 115B comprise inwardly-facing inclined surfaces 135A, 135B, respectively, which contact the wedge 90. Inclined surfaces 135A, 135B preferably comprise a plurality of grooves 137A, 137B (FIG. 4D), respectively, for receiving dovetail sliders 120 disposed on the distal portion of wedge 90, whereby to slidably mount first tether element 115A and second tether element 115B to the distal portion of wedge 90. See FIGS. 4, 4D and 5. Tether elements 115A, 115B are preferably formed out of a hardened material (e.g., steel) capable of delivering extreme forces to the rock in order to split the rock, as will hereinafter be discussed.

Figure 6:
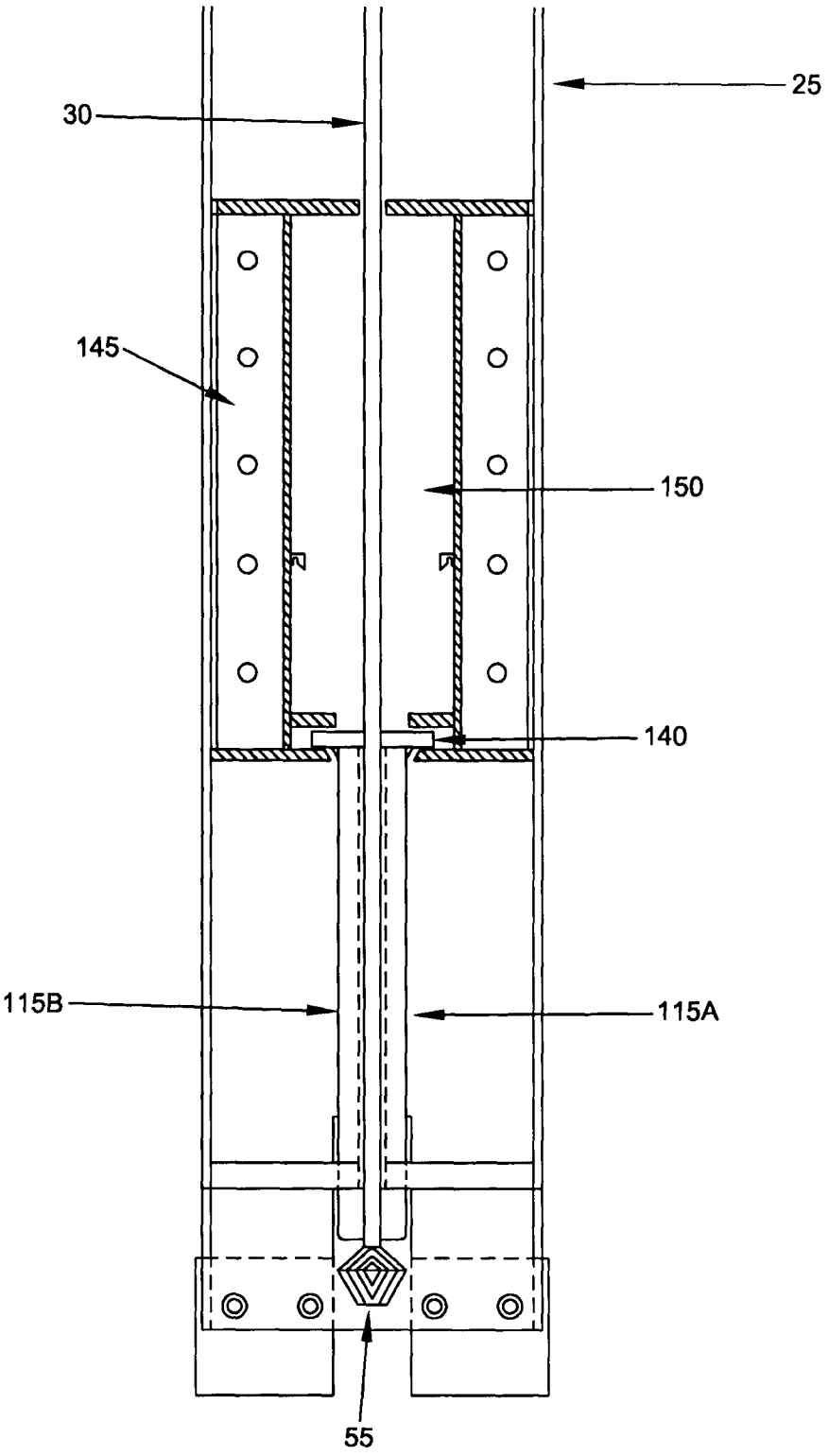
FIGS. 6-8 are schematic views showing further details of the novel splitter assembly of FIG. 4.
Figure 7:
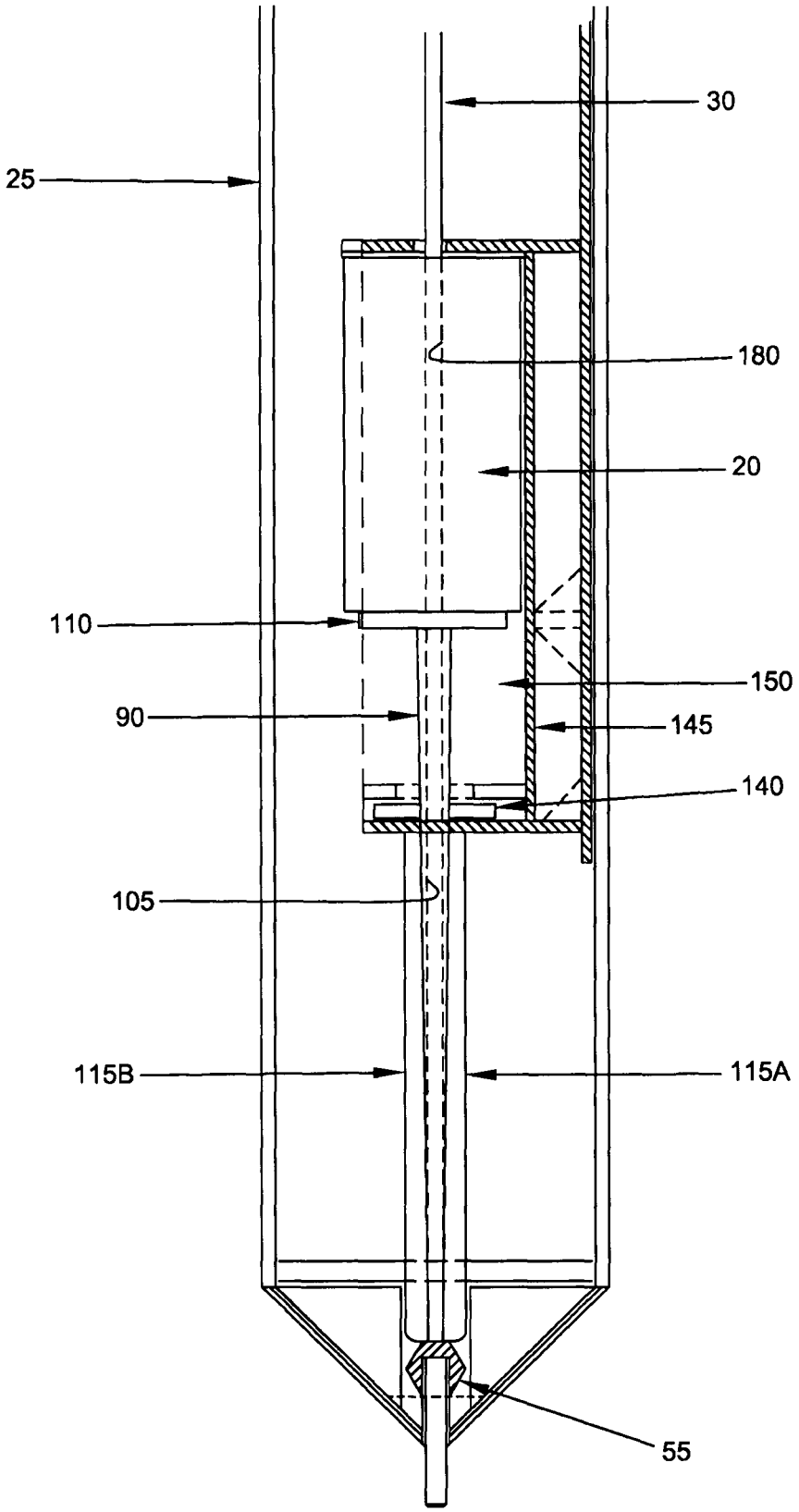
Figure 8:
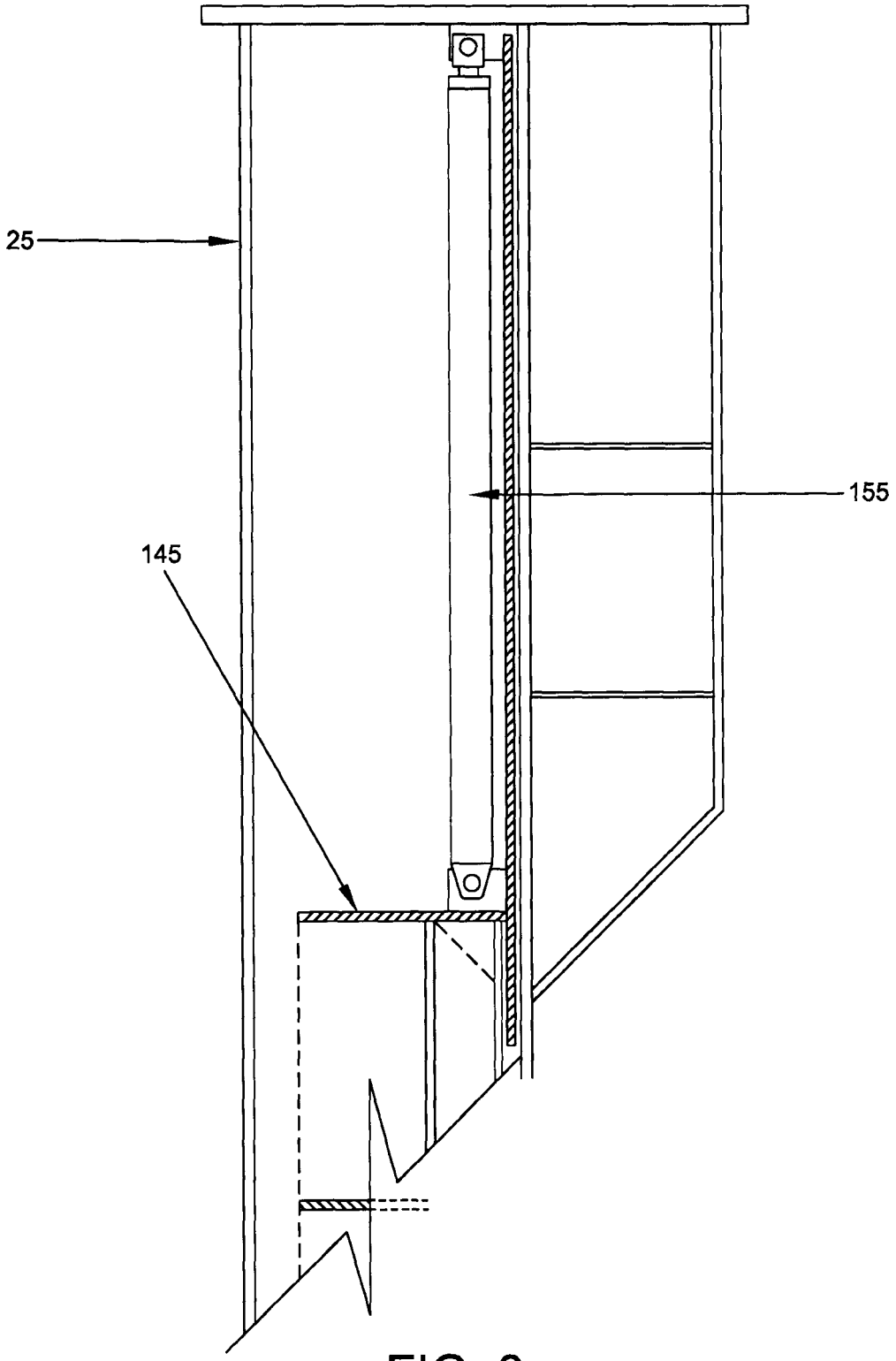

Looking next at FIGS. 6-8, tether 85 also comprises a flange 140 (i.e., a flange extending radially outboard of the proximal end of each tether element 115A, 115B) which is received in a tether drive element 145. Tether drive element 145 is configured to move longitudinally within housing 25 so as to selectively advance/retract (i.e., move distally/proximally) tether elements 115A, 115B relative to housing 25. As a result, drill assembly 10 may be used to drill a hole in a rock while housing 25 of novel rock splitting apparatus 5 abuts the face of the rock or is suspended above the rock, and tether elements 115A, 115B may be advanced distally out of housing 25 and into the drill hole formed in the rock. In a preferred form of the invention, tether drive element 145 comprises a chamber 150 slidably disposed within housing 25 which may be selectively moved longitudinally (i.e., slid distally or proximally) via a hydraulic piston 155 (FIG. 8). In a preferred form of the invention, hydraulic ram 20 is also mounted to tether drive element 145 (FIG. 7) and moves when tether drive element 145 is moved, whereby to allow wedge 90 and tether 85 to move in a coordinated fashion (i.e., together as a single unit) when tether 85 is advanced into the drill hole, such that wedge 90 does not advance distally relative to tether 85 as tether 85 is advanced into the drill hole. Since hydraulic ram 20 is mounted to tether drive element 145, hydraulic ram 20 is only used to advance wedge 90 relative to tether 85 after tether 85 has been disposed in the drill hole, as will hereinafter be discussed in further detail.

It should be appreciated that tether 85 comprises a radially-reduced profile at distal ends 130A, 130B of tether elements 115A, 115B when wedge 90 is in its proximal most position, i.e., a radially-reduced configuration wherein the distal end of tether 85 comprises a diameter slightly smaller than the diameter of drill bit 55. When wedge 90 is moved distally, wedge 90 contacts inclined surfaces 135A, 135B of tether elements 115A, 115B and forces tether elements 115A, 115B radially outboard such that distal ends 130A, 130B assume a radially-expanded configuration. Thus, when wedge 90 is in its distal most position, distal ends 130A, 130B of tether elements 115A, 115B will be in a radially-expanded configuration, i.e., a configuration wherein the distal end of tether 85 comprises a diameter larger than the diameter of drill bit 55 (and hence, a diameter larger than the diameter of a hole drilled in rock using drill bit 55). As a result, when tether 85 is disposed in a hole formed in a rock and wedge 90 is thereafter advanced distally, tether 85 (i.e., tether elements 115A, 115B) bears against the wall of the hole formed in the rock, whereby to split the rock.

It should be appreciated that the foregoing construction permits drilling into a rock using drill bit 55 while tether 85 and wedge 90 are maintained proximal to, or even disposed within, the hole formed in the rock. As a result, when it is desired to split the rock, drill assembly 10 is used to drill a hole into the rock (i.e., by rotating hollow drill shaft 30 and advancing drill bit 55 distally into the rock as drill bit 55 is rotated using drill drive element 50), tether 85 is advanced distally into the hole formed in the rock (i.e., with drill bit 55 and hollow drill shaft 30 remaining within the drill hole), and wedge 90 is then advanced distally over hollow drill shaft 30 (i.e., with hollow drill shaft 30 passing through bore 105 of wedge 90) into tether 85, whereby to force tether 85 to expand radially outboard within the hole formed in the rock and thereby split the rock. Importantly, this permits rock to be split without removing drill bit 55 or hollow drill shaft 30 from the hole formed in the rock, thereby eliminating the need for removing the drill from the hole formed in the rock and the need to insert a tether/wedge mounted to a second excavator into the drill hole.

Hydraulic Ram 20

As discussed above, the force used to split the rock is delivered to the rock (i.e., to the side walls of the hole drilled in the rock) by driving wedge 90 distally into tether 85 while tether 85 is disposed within a hole drilled into the rock. It will, therefore, be appreciated that significant force is often necessary in order to drive wedge 90 distally into tether 85. By way of example but not limitation, one or more hydraulic cylinders may be used to drive tapered wedge 90 distally. Alternatively, other types of motors or hydraulic means may be utilized to drive tapered wedge 90 distally and will be apparent to those skilled in the art in view of the present disclosure.

In a preferred form of the present invention, wedge 90 is driven distally via hydraulic ram 20. Since novel rock splitting apparatus 5 combines a drill assembly 10 with splitter assembly 15, and since drill drive element 50 and the proximal portion of hollow drill shaft 30 need to be disposed above (i.e., proximal to) wedge 90, tether 85, tether drive element 145 and hydraulic ram 20 in order to provide sufficient length for hollow drill shaft 30, hollow drill shaft 30 needs to be able to pass through hydraulic ram 20. Put another way, inasmuch as hollow drill shaft 30 needs to be significantly longer than tether 85 and wedge 90 and needs to be able to translate distally/proximally within housing 25 of rock splitting apparatus 5, hollow drill shaft 30 must pass through tether drive element and hydraulic ram 20.

Novel Hydraulic Ram

Figure 9:
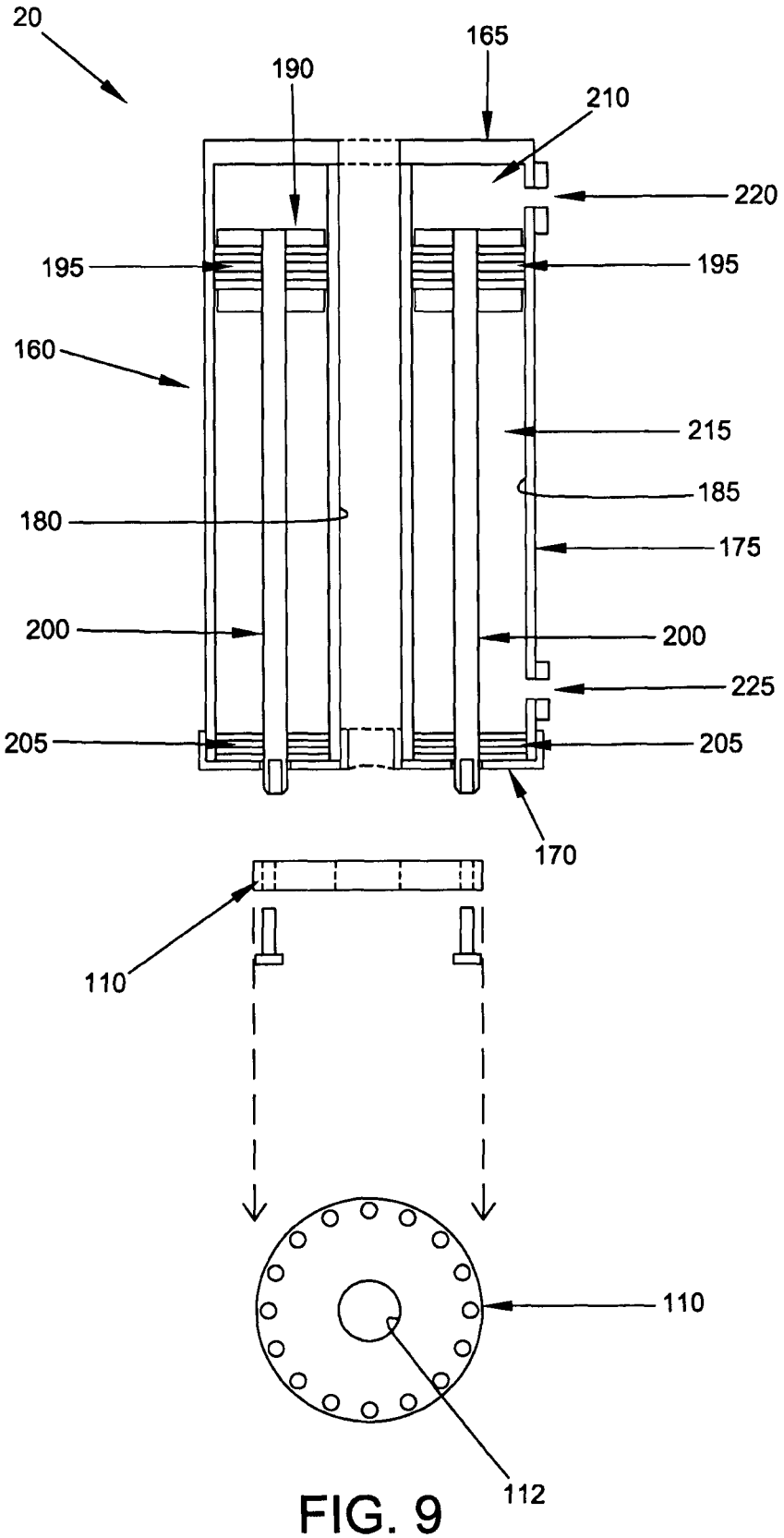
FIG. 9 is a schematic view showing a novel hydraulic ram formed in accordance with the present invention.
Figures 10, 10A:
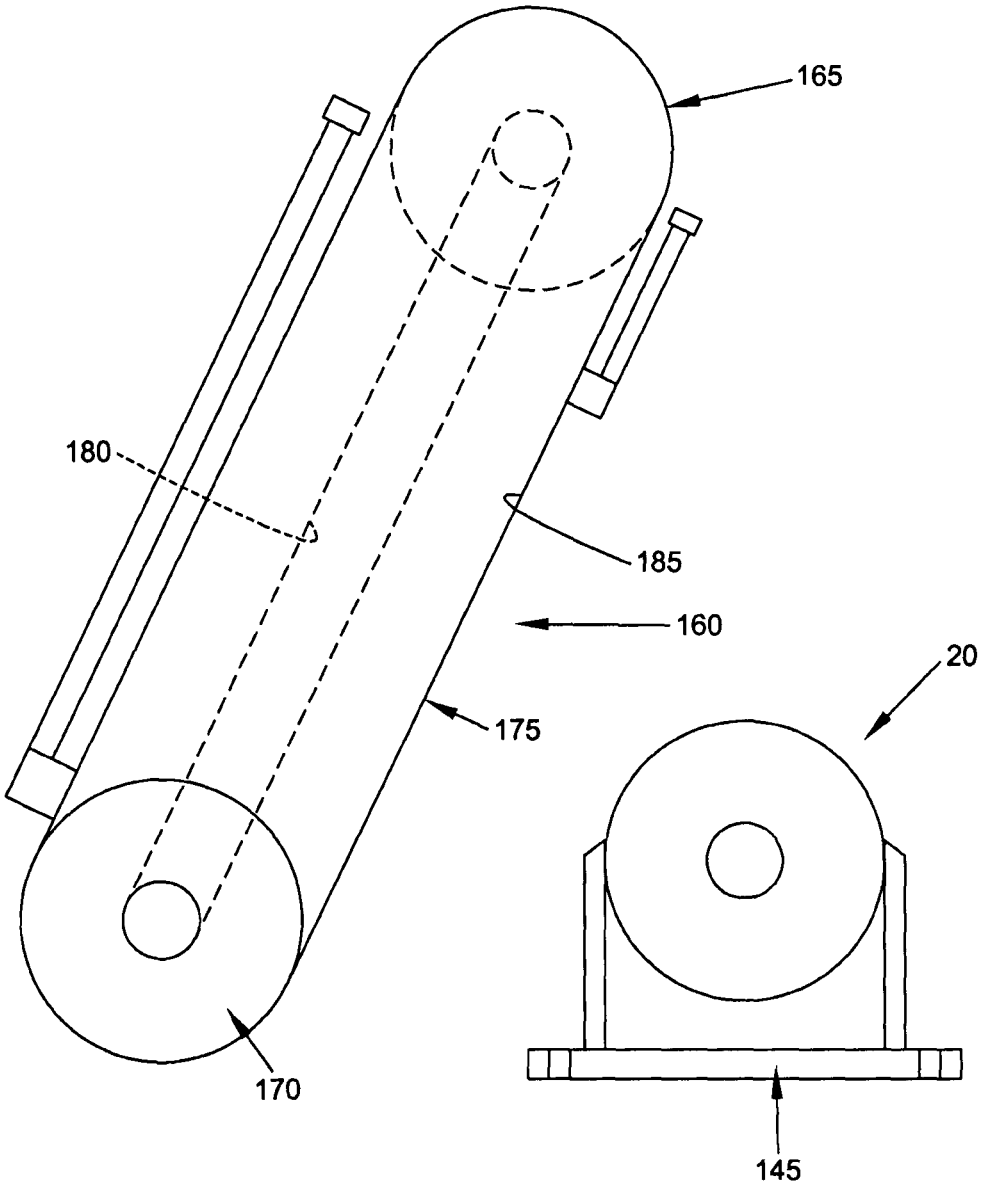
FIGS. 10 and 10A are schematic views showing further details of the novel hydraulic ram of FIG. 9.

Looking now at FIGS. 9, 10 and 10A, there are shown further details of novel hydraulic ram 20. More particularly, hydraulic ram 20 preferably comprises a cylindrical hydraulic barrel 160 which is preferably mounted within chamber 150 of tether drive element 145. A cylinder barrel cap 165 covers the proximal end of hydraulic barrel 160, a base cap 170 covers the distal end of hydraulic barrel 160 and a cylindrical side wall 175 extends between cylinder barrel cap 165 and base cap 170. A central tube 180 passes through cylinder barrel cap 165, through hydraulic barrel 160 and through base cap 170. A hydraulic chamber 185 extends coaxially around central tube 180, bounded by cylinder barrel cap 165, base cap 170 and cylindrical side wall 175. As a result, hydraulic chamber 185 comprises a generally "doughnut"-shaped cross-section, by virtue of the fact that central tube 180 extends through hydraulic chamber 185 and is fluidically segregated from hydraulic chamber 185.

A piston 190 is disposed coaxially about central tube 180 and is movably disposed within hydraulic chamber 185. Piston 190 is able to move either distally or proximally when actuated via introduction (or removal) of hydraulic fluid into (or out of) hydraulic chamber 185, as will hereinafter be discussed. Piston 190 is sized so as to tightly (but slidably) fit within hydraulic chamber 185, and comprises one or more seals 195 for fluidically sealing against the inner surface of cylindrical side wall 175 of hydraulic barrel 160 and against the outer surface of central tube 180. One or more piston rods 200 are mounted to piston 190 and extend distally therefrom. Piston rods 200 pass through one or more base cap seals 205 and through base cap 170. In a preferred form of the present invention, piston rods 200 comprise a single cylindrical structure (i.e., a single cylindrical piston rod) disposed coaxially about central tube 180, however, other configurations of piston rods 200 will be apparent to those skilled in the art in view of the present disclosure.

It will be appreciated that, as a result of the foregoing construction, piston 190 divides hydraulic chamber 185 into an upper chamber 210 and a lower chamber 215 which are fluidically sealed off from one another. A port 220 permits hydraulic fluid to be selectively introduced into/removed from upper chamber 210, and a port 225 permits hydraulic fluid to be introduced into/removed from lower chamber 215. Ports 220, 225 are fluidically connected to a hydraulic pump and fluid reservoir (not shown), whereby to permit hydraulic fluid to be selectively introduced into/removed from upper chamber 210 or lower chamber 215.

The distal ends of piston rods 200 are mounted to wedge plate 110. As a result of this construction, wedge plate 110 (and hence, wedge 90 mounted thereto) can be driven distally by introducing hydraulic fluid into upper chamber 210 of hydraulic ram 20 via port 220 (and, simultaneously, removing hydraulic fluid from lower chamber 215 via port 225) so as to drive piston 190 distally. Alternatively, wedge plate 110 (and hence, wedge 90 mounted thereto) can be retracted proximally by introducing hydraulic fluid into lower chamber 215 of hydraulic ram 20 via port 225 (and, simultaneously, removing hydraulic fluid from upper chamber 210 via port 220) so as to drive piston 190 proximally.

Lubrication System

Figure 11:
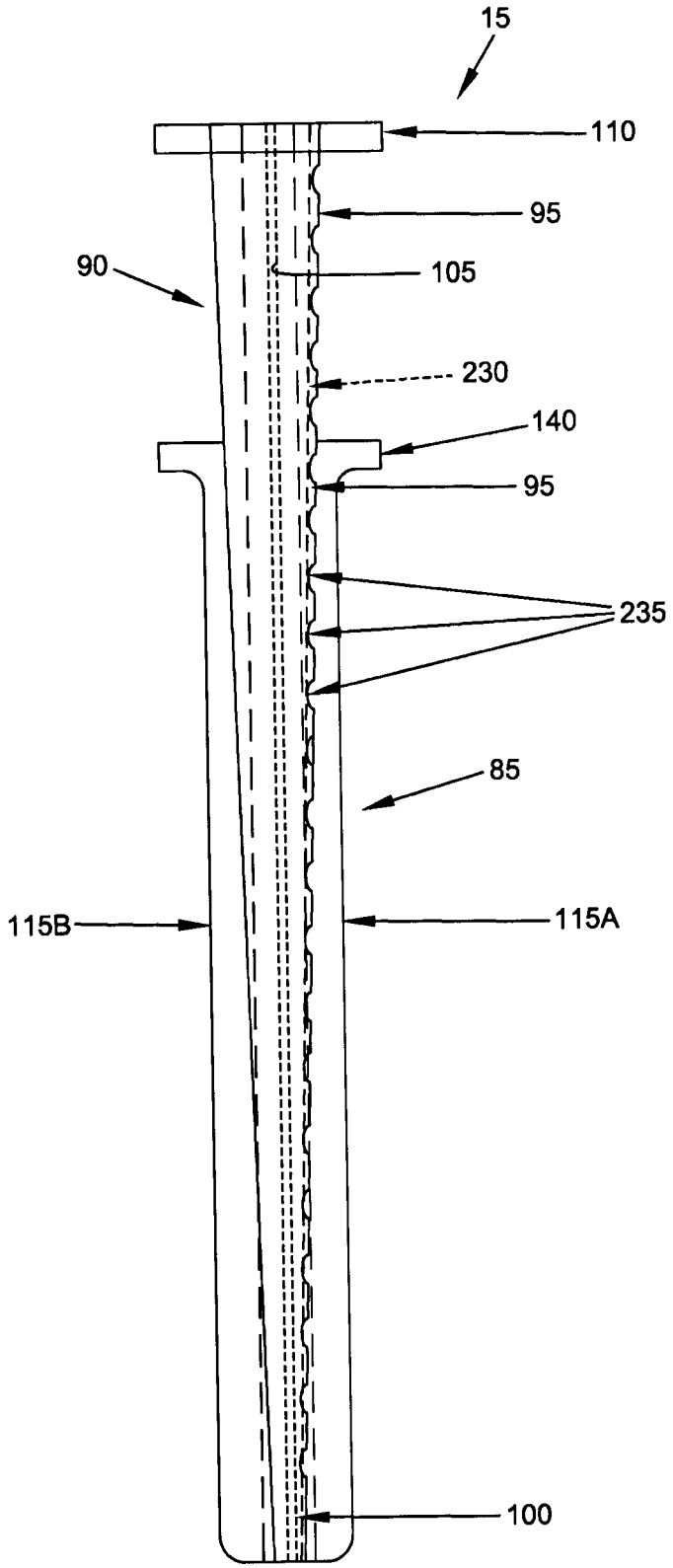
FIG. 11 is a schematic view showing another novel splitter assembly formed in accordance with the present invention.

It has been recognized that it can be challenging to drive wedge 90 distally into the space between tether elements 115A, 115B of tether 85, inasmuch as extraordinary force can be required in order to split the rock, sometimes causing wedge 90 and tether 85 to bind to one another. In order to address this issue, and looking now at FIG. 11, if desired, wedge 90 may comprise a lubricant channel 230 fluidically connected to a plurality of lubricant ports 235 formed along the length of wedge 90, through which grease (or another suitable lubricant) supplied from a grease tank (not shown) may be extruded. Lubricant ports 235 allow grease to pass from a grease tank, through lubricant channel 230 to the area between the outer surface of wedge 90 and inclined surfaces 135A, 135B of tether elements 115A, 115B. Although only a single lubricant channel 230 is shown in FIG. 11 for supplying lubricant to a plurality of lubricant ports 235 on one side of wedge 90, if desired additional lubricant channels 230 may be provided and lubricant ports 235 may be disposed all around wedge 90. As a result, grease (or another suitable lubricant) can be used to facilitate movement of wedge 90 relative to tether 85 and can facilitate efficient splitting of rock and/or proximal movement of wedge 90 relative to tether 85.

Alternative Configurations and Uses of Rock Splitting Apparatus 5

Figure 12:
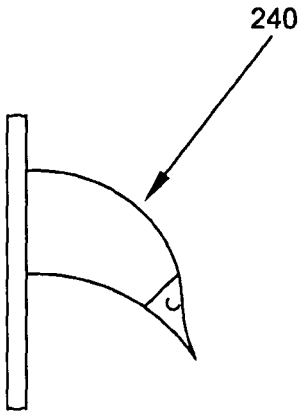
FIG. 12 is a schematic view of a novel ripper for use with the novel rock splitting apparatus of the present invention.
Figure 13:
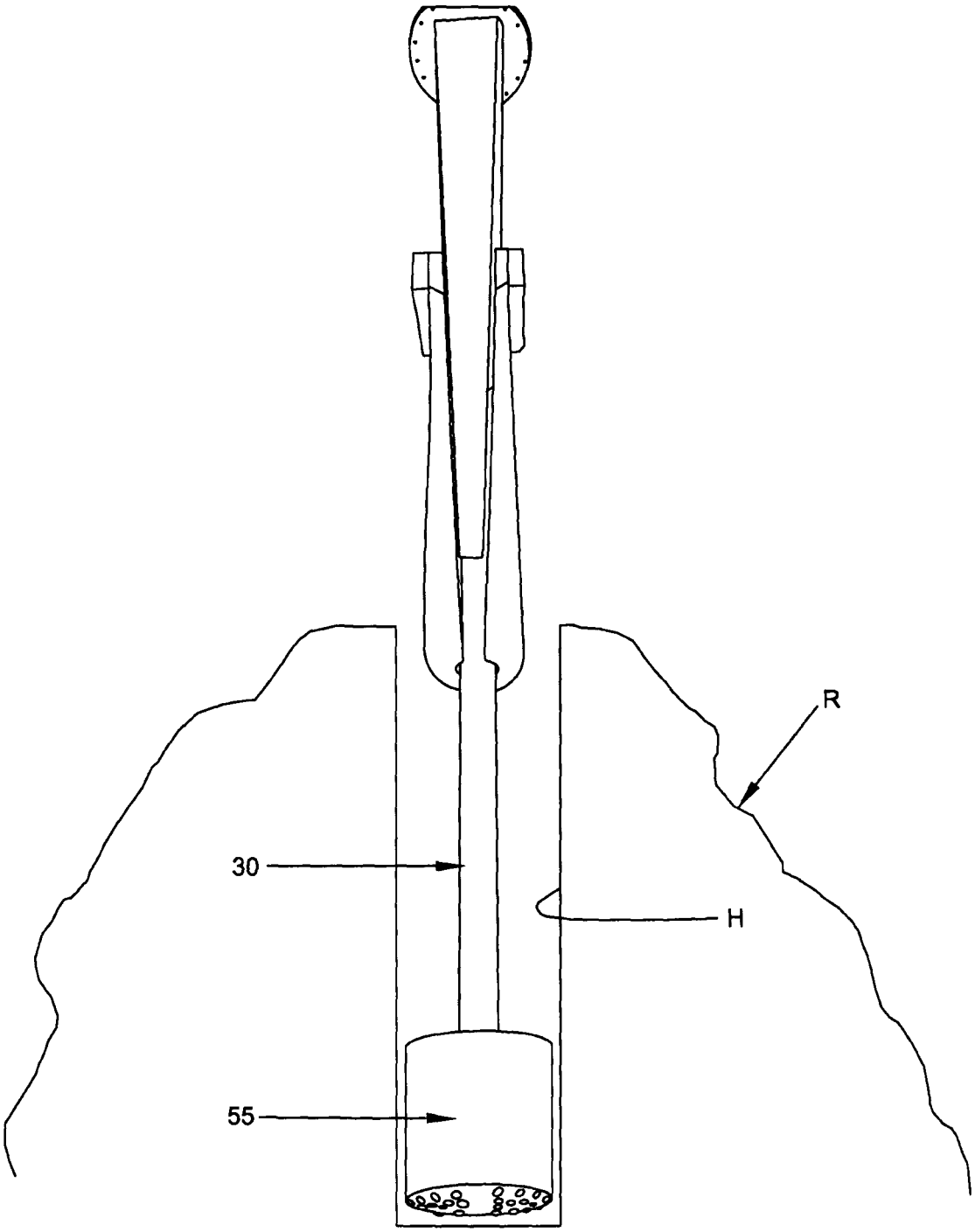
FIGS. 13-16 are schematic views showing how the novel rock splitting apparatus of the present invention may be used to split a rock.
Figure 14:
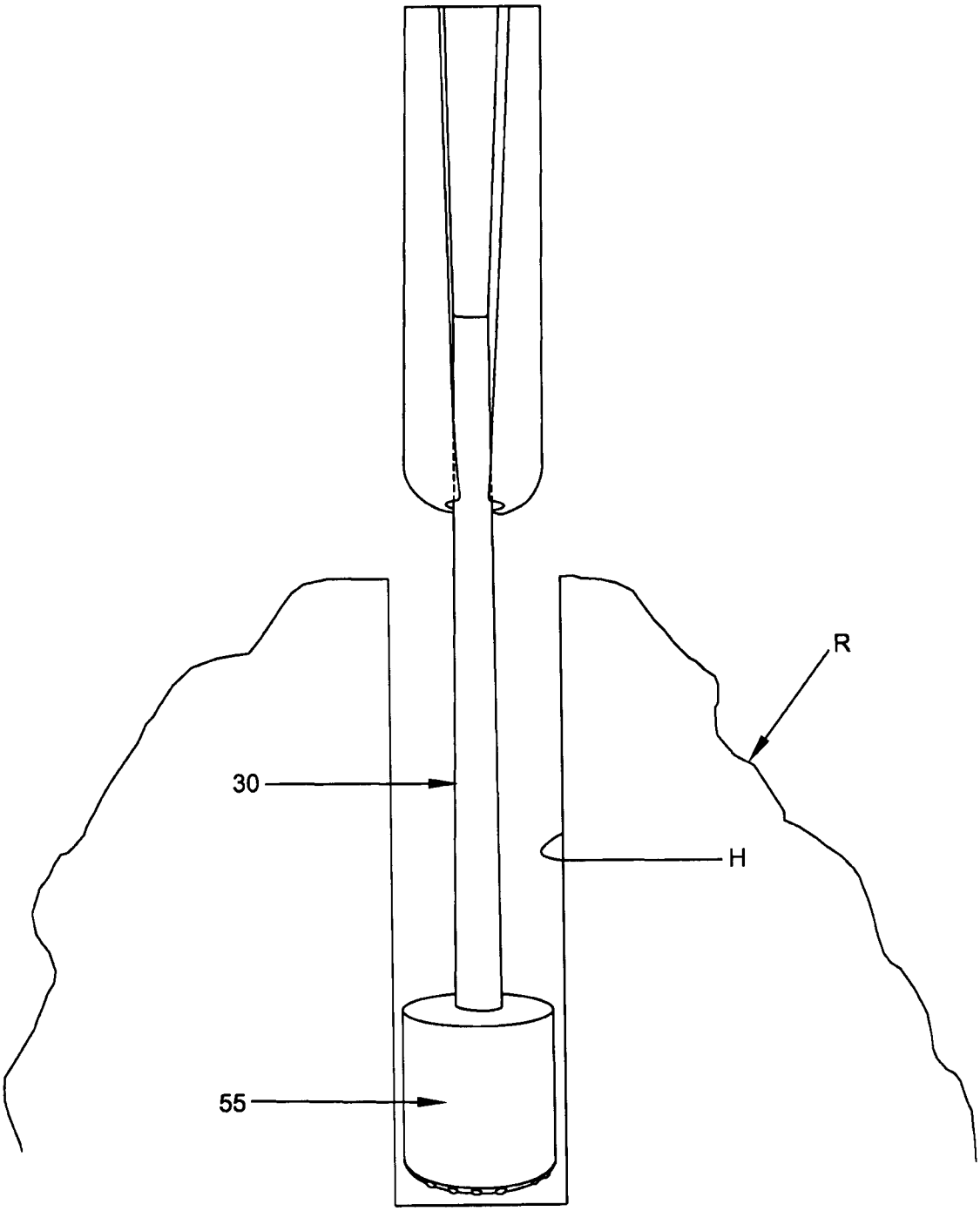
Figure 15:
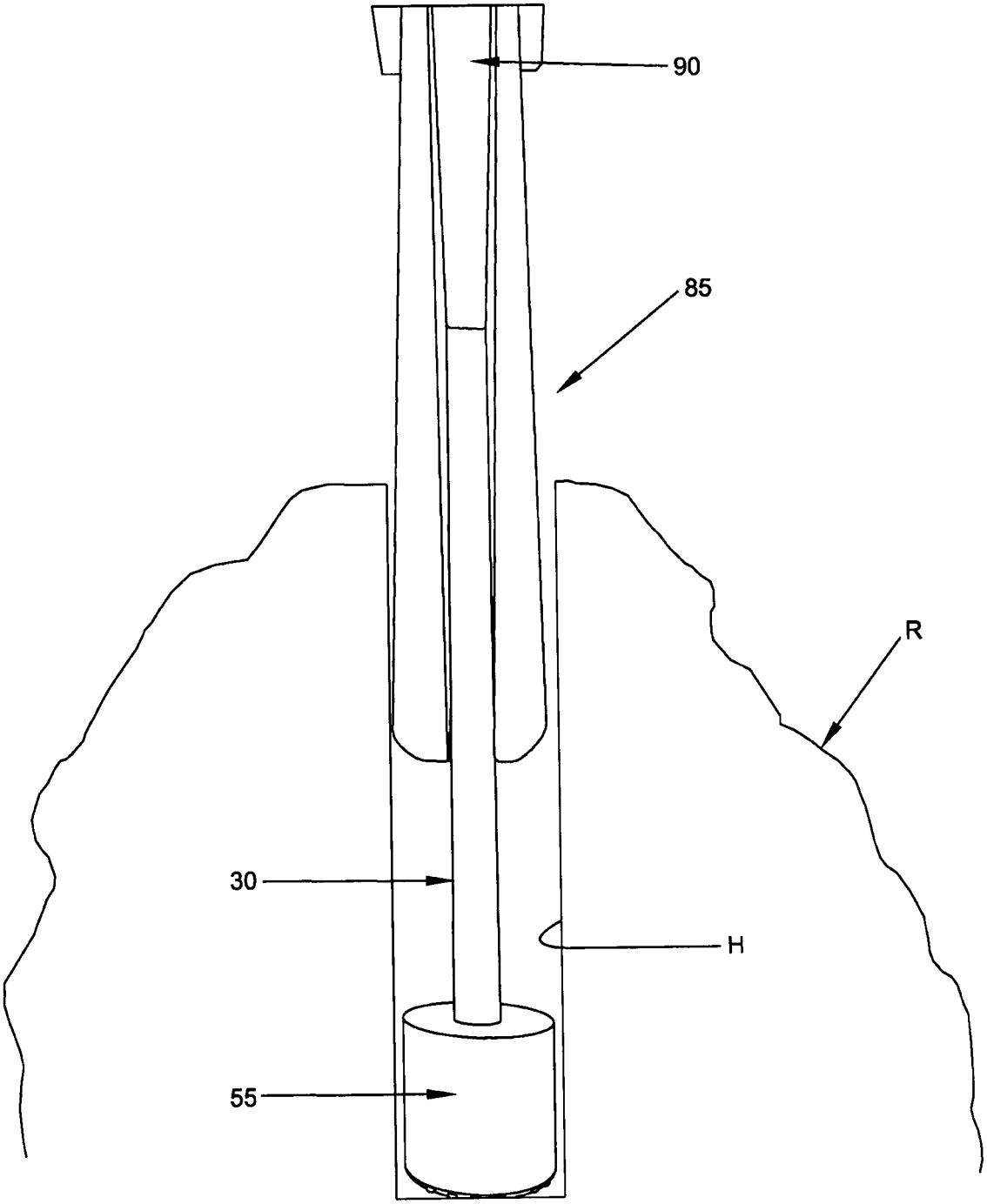
Figure 16:
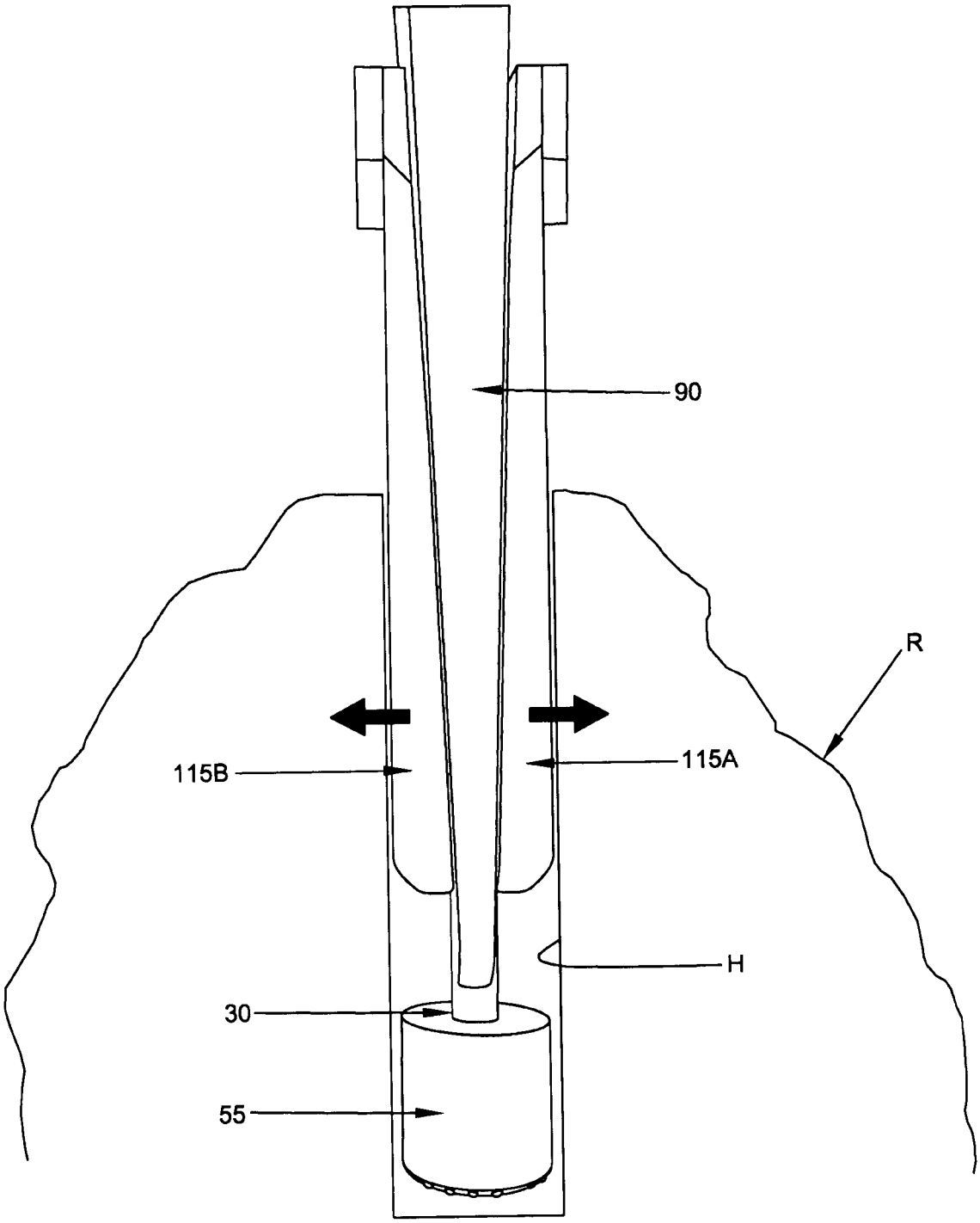

It has also been appreciated that inasmuch as novel rock splitting apparatus 5 is attached to the end of an excavator, the operator of the excavator may desire to use housing 25 to clear debris from the construction area. More particularly, by configuring the excavator arm such that housing 25 is presented generally horizontal to the plane of the ground (or angled, as desired), housing 25 may be used to sweep or level a construction area (i.e., using a side of housing 25 and/or one of the edges of housing 25). In addition, it has also been recognized that in some situations, it is desirable to use housing 25 to grip and/or pull debris and/or rock at a worksite. For this reason, and looking now at FIG. 12, in another form of the invention housing 25 is provided with one or more rippers 240. Rippers 240 generally comprise hook-shaped claws formed integral with, or mounted to, housing 25, and may have a sharp tip (i.e., for penetrating and gripping debris). As a result, an operator may manipulate the arm of the excavator to which novel rock splitting apparatus 5 is attached so as to grip and/or manipulate debris at the worksite using rippers 240.

And in a preferred form of the invention, and looking at FIG. 1, housing 25 may comprise attachment means 245 for mounting novel rock splitting apparatus 5 to an excavator (or other suitable piece of equipment).

Although novel rock splitting apparatus 5 is intended to be mounted to the free end of an adjustable arm on an excavator, it should also be appreciated that novel rock splitting apparatus 5 may instead be mounted to other types of equipment or to a stationary frame (e.g., such that rocks to be split are brought to novel rock splitting apparatus 5 rather than brining novel rock splitting apparatus 5 to the rock that is to be split. Alternatively, novel rock splitting apparatus 5 may be scaled down for manual use.

Use of Novel Rock Splitting Apparatus 5

In use, and looking now at FIGS. 13-16, novel rock splitting apparatus 5 is preferably mounted to the free end of the arm of an excavator (or other suitable piece of equipment) via attachment means 245. In addition to mounting novel rock splitting apparatus 5 via attachment means 245, control connections (not shown) between novel rock splitting apparatus 5 and the excavator may also established in order to allow the operator of the excavator to control the functions of novel rock splitting apparatus 5 (e.g., movement of the various components of novel rock splitting apparatus 5) from the cab of the excavator and are configured in a manner known in the art.

Next, the operator positions the excavator's arm (not shown) such that novel rock splitting apparatus 5 (connected to the excavator arm) is positioned above the section of rock R which the operator desires to cleave. Drill drive element 50 is activated so as to cause hollow drill shaft 30 and drill bit 55 to rotate. Novel rock splitting apparatus 5 is then adjusted so that distal end of housing 25 is at or near the face of the rock which is to be split. With hollow drill shaft 30 and drill bit 55 rotating, screw drive 65 is actuated (i.e., rotated) so as to move drill drive element 50 (and hence, hollow drill shaft 30 mounted to drill drive element 50 and drill bit 55) distally. As this occurs, drill bit 55 engages the rock and begins to drill into it, boring a drill hole H roughly the diameter of drill bit 55. See FIGS. 13 and 14.

As this occurs, drilled rock fragments (i.e., debris) are forced out the drill hole by virtue of high pressure air that is generated by air compressor 80 and which passes through hollow drill shaft 30 and out openings 70 of drill bit 55. The debris is then forced out of drill hole H behind drill bit 55 and emitted therefrom.

At this point, tether drive element 145 is actuated so as to move tether 85 distally. As this occurs, first tether element 115A and second tether element 115B enter into drill hole H on opposite sides of hollow shaft 30. Tether elements 115A, 115B are advanced as far distally as is possible or until tether flange 140 contacts the face of rock R that is to be split (i.e., until tether 85 is fully inserted into the drill hole). See FIG. 15.

After tether 85 has been inserted into the drill hole, hydraulic ram 20 is used to drive wedge 90 distally into the space between tether elements 115A, 115B. More particularly, in a preferred form of the invention, hydraulic fluid is forced into upper chamber 210 of hydraulic barrel 160, forcing piston 190 distally. This action causes piston rods 200 to also move distally, bearing against wedge plate 110 and forcing wedge 90 distally. As this occurs, wedge 90 bears against inclined surfaces 135A, 135B of first tether element 115A and second tether element 115B, respectively, driving tether elements 115A, 115B radially outboard against the side wall of drill hole H. This radially-directed force causes rock R to split. See FIG. 15.

After the rock is split, wedge 90 is withdrawn proximally, e.g., by forcing hydraulic fluid into lower chamber 215 of hydraulic barrel 160, whereby to move piston 190 and piston rods 200 proximally, whereby to also move wedge plate 110 and hence wedge 90 proximally. After wedge 90 has been fully withdrawn proximally, tether 85 is withdrawn proximally by moving tether drive element 145 proximally within housing 25. Finally, hollow drill shaft 30 and drill bit 55 are also withdrawn proximally until all of the elements of novel rock splitting apparatus 5 are clear of any debris.

It should be appreciated that although the foregoing procedure is described as occurring sequentially, if desired, it is also possible to withdrawn one or more of wedge 85, tether 90 and drill assembly 10 proximally simultaneously.

The entire novel rock splitting apparatus 5 may then be moved to another nearby location, where the process may be repeated and additional rock cleaved.

The novel rock splitting apparatus 5 has been described herein as being configured to be attached to and used in connection with an excavator or similar machine, however, it will be appreciated that the apparatus may be attached to other pieces of equipment or may be configured so as to be operated independently of other equipment.

Alternative Rock Splitting Apparatus

Figure 17:
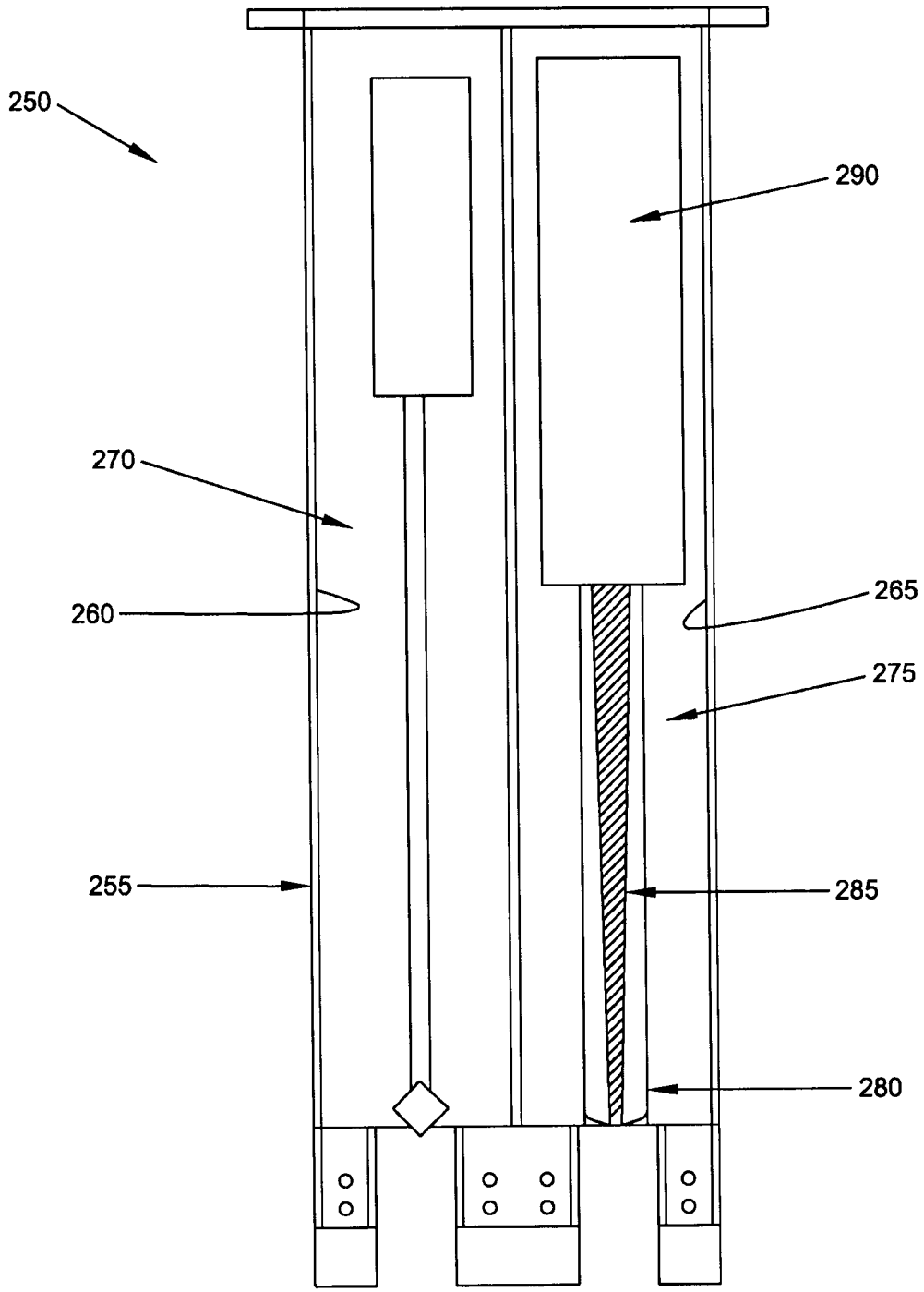
FIG. 17 is a schematic view showing another novel rock splitting apparatus formed in accordance with the present invention.

Looking now at FIG. 17, there is shown an alternative novel rock splitting apparatus 250. Novel rock splitting apparatus 250 is generally similar to novel rock splitting apparatus 5 discussed above, however, in this form of the invention, drill assembly 10 is disposed next to, rather than in line with, splitter assembly 15 and hydraulic ram 20.

More particularly, and still looking at FIG. 17, novel rock splitting apparatus 250 comprises a housing 255 having a drill chamber 260 and a splitter chamber 265 disposed next to drill chamber 260. A drill assembly 270 (which is substantially identical to the aforementioned drill assembly 10) is movably disposed within drill chamber 260 such that drill assembly 270 can be moved longitudinally distally or proximally relative to housing 255 (i.e., via a screw drive or other drive means configured substantially similar to the aforementioned screw drive 65). Drill assembly 270 is substantially similar to the aforementioned drill assembly 10 (i.e., drill assembly 270 comprises a hollow drill shaft having a proximal end and a distal end, a drill drive element mounted to the proximal end of the hollow drill shaft and a drill bit mounted to the distal end of the hollow drill shaft) and operates in a substantially similar fashion to the aforementioned drill assembly 10. However, since drill assembly 270 is disposed next to, rather than above, the splitter assembly, drill assembly 270 can comprise a shorter length than the aforementioned drill assembly 10, and hence, housing 255 can be shorter (i.e., in the distal-to-proximal longitudinal dimension) than the aforementioned housing 25.

A splitter assembly 275 is disposed within splitter chamber 265. Splitter assembly 275 is substantially similar to the aforementioned splitter assembly 15 (i.e., splitter assembly 275 comprises a tether comprising two tapered tether elements and a wedge for moving relative to the tether, such that distal movement of the wedge causes the tether to expand radially outboard, whereby to split rock) and operates in a substantially similar manner to the aforementioned splitter assembly 15. More particularly, splitter assembly 275 comprises a tether 280 and a wedge 285 slidably mounted to tether 280 (e.g., via dovetail sliders disposed at the distal end of wedge 285, not shown). Since drill assembly 270 is now mounted next to splitter assembly 275 and does not need to pass through splitter assembly 275 in order to drill a hole into the rock that is to be split, wedge 285 can be formed without a central bore passing therethrough. Similarly, inasmuch as there is no need for a hydraulic ram having a central tube passing therethrough (i.e., a hydraulic ram 20 having a central tube 180 passing therethrough for permitting hollow drill shaft 30 to pass through hydraulic ram 20), wedge 285 can be moved distally by a conventional hydraulic 290 piston or by other means which will be apparent to those skilled in the art in view of the present disclosure.

In operation, novel rock splitting apparatus 250 functions in much the same way as in the previously discussed novel rock splitting apparatus 5, however, the steps of drilling a hole into the rock and using tether 280 and wedge 285 to cleave the rock requires lateral movement of novel rock splitting apparatus 250 (i.e., lateral repositioning of novel rock splitting apparatus 250 perpendicular to the direction that the hole is drilled into the rock). More particularly, after the hole is drilled into the rock that is to be split, drill assembly 270 is retracted and novel rock splitting apparatus 250 is moved laterally so as to align splitter assembly 275 with the hole drilled in the rock. Tether 280 is then advanced distally into the hole formed in the rock (e.g., via actuation of a tether drive element, not shown, which is substantially similar to the aforementioned tether drive element 145), wedge 285 is moved distally so as to engage tether 280 and force the elements of tether 280 radially outboard, whereby to cleave the rock.

Alternatively, rather than moving novel rock splitting apparatus 250 laterally, novel rock splitting apparatus 250 can be configured to rotate about a longitudinal axis of novel rock splitting apparatus 250 in order to align splitter assembly 275 with the hole drilled in the rock after drill assembly 270 has been used to form a hole in the rock. By way of example but not limitation, novel rock splitting apparatus 250 may be configured such that 180 degree rotation of novel rock splitting apparatus 250 aligns splitter assembly 275 with the hole drilled in the rock after drill assembly 270 has been used to form the hole in the rock. This form of the invention avoids some of the difficulty that may otherwise be encountered in lining up splitter assembly 275 with the drill hole by laterally moving novel rock splitting apparatus 250.

Novel Debris Removal System

As discussed above, as a drill bit (e.g., the aforementioned drill bit 55) is advanced into a rock (or other material) during drilling, debris builds up in the drill hole as the hole is drilled. In one form of the present invention, compressed air is passed through a hollow drill shaft (e.g., through the aforementioned bore 45 of hollow drill shaft 30) and exits out of the drill bit (e.g., through the aforementioned openings 70 formed in drill bit 55). The introduction of compressed air into the confined volume of a drill hole creates a pressure differential that forces (i.e., "blows") debris up out of the top opening of the drill hole as it is being drilled. The debris can then be collected and removed from the worksite (e.g., via manual labor).

However, such an approach presents several significant drawbacks. By way of example but not limitation, such an approach requires workers to approach the hole being drilled while the drill is active—a potentially hazardous condition wherein workers are exposed to moving parts (e.g., a rotating drill shaft) and debris exiting the drill hole. By way of further example but not limitation, where the material being drilled is pulverized into a fine powder through the drilling process (e.g., as may occur when drilling through coal, chalk, etc.), the aerosolized powder exiting the drill hole may present a hazardous health condition to workers in the vicinity of the drill hole and/or may make cleaning up the worksite more difficult and/or labor intensive.

Figure 18:
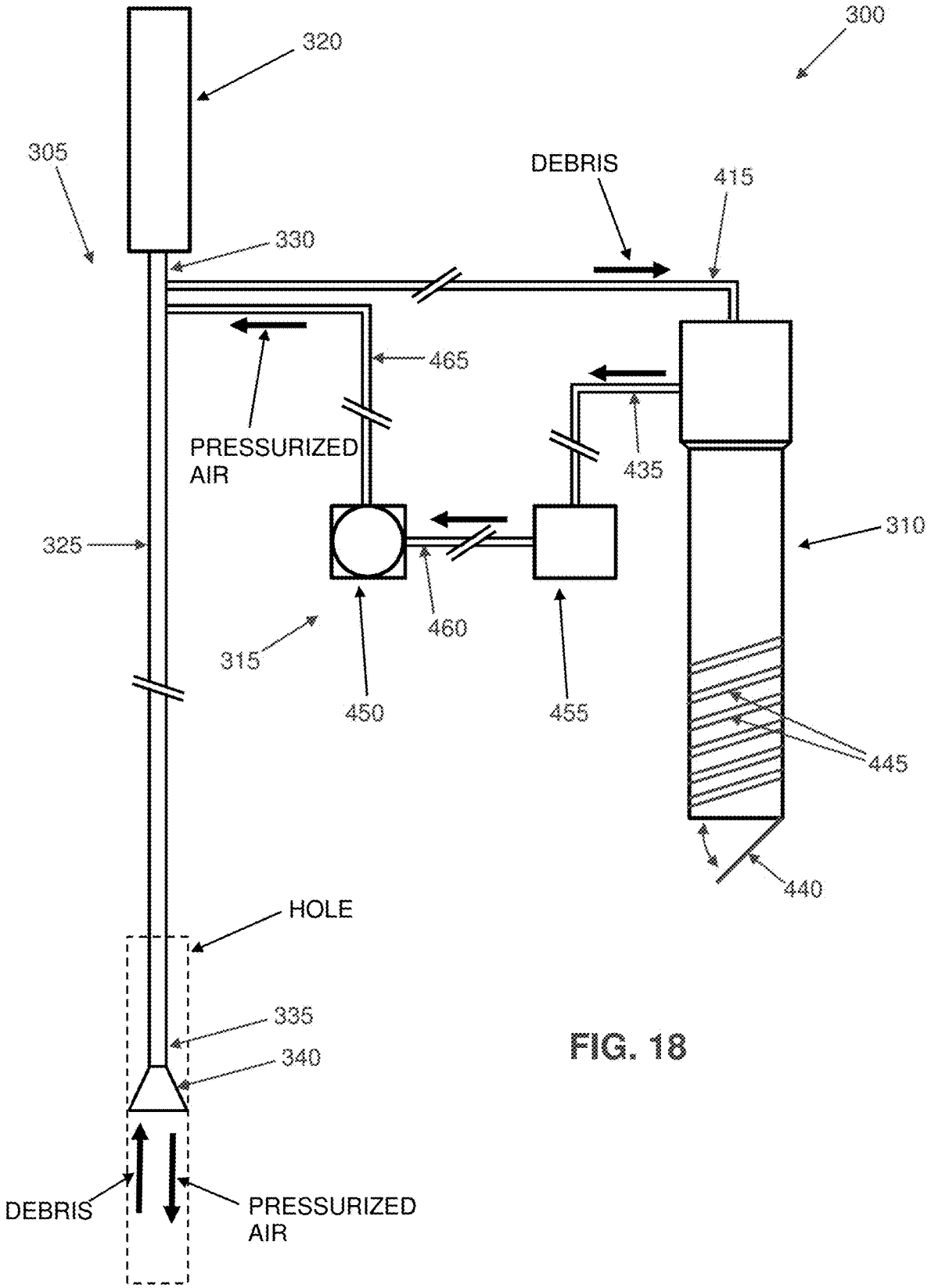
FIG. 18 is a schematic view showing a novel debris removal system formed in accordance with the present invention.

To address such drawbacks, in another preferred form of the invention, and looking now at FIG. 18, there is provided a novel debris removal system 300 configured to blow pressurized air into a drill hole during drilling while simultaneously removing debris from the drill hole using suction (i.e., a vacuum), such that the debris is removed from the drill hole and deposited in a container for storage and disposal. In one preferred form of the present invention, the air used for pressurizing the drill hole and suctioning debris from the drill hole is filtered and re-cycled through the system, as will hereinafter be discussed in further detail.

Novel debris removal system 300 generally comprises a drill assembly 305, a separator tank 310 and an air handling system 315.

Figure 19:
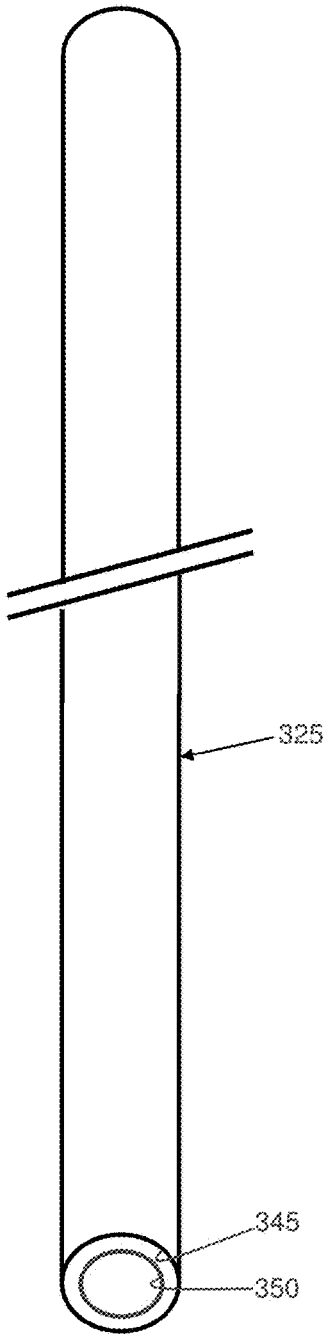
FIG. 19 is a schematic view showing a novel drill rod formed in accordance with the present invention.

More particularly, and looking now at FIGS. 18 and 19, drill assembly 305 generally comprises a drill drive element 320 (e.g., a pneumatic motor, an electric motor, etc.) for selectively driving rotation of a dual-lumen drill rod 325. Dual-lumen drill rod 325 comprises a proximal end 330 for mounting to drill drive element 320, and a distal end 335 for mounting to a dual-channel drill bit 340, as will hereinafter be discussed in further detail.

Dual-lumen drill rod 325 comprises a pressurized air lumen 345 and a debris vacuum lumen 350, with pressurized air lumen 345 being fluidically segregated from debris vacuum lumen 350. In a preferred form of the invention, pressurized air lumen 345 and debris vacuum lumen 350 are disposed coaxial with one another (i.e., in the manner shown in FIG. 19), however, it should be appreciated that other configurations for lumens 345, 350 are possible and fall within the scope of the present invention in view of the present disclosure.

Figure 20:
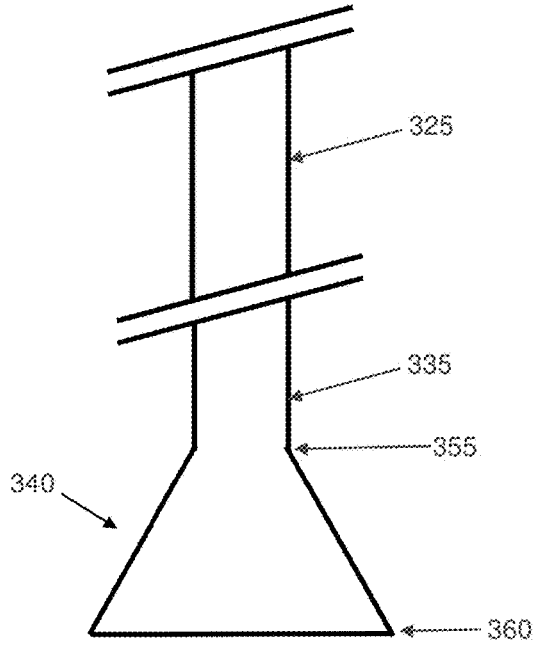
FIGS. 20 and 21 are schematic views showing a novel drill bit formed in accordance with the present invention.
Figure 21:
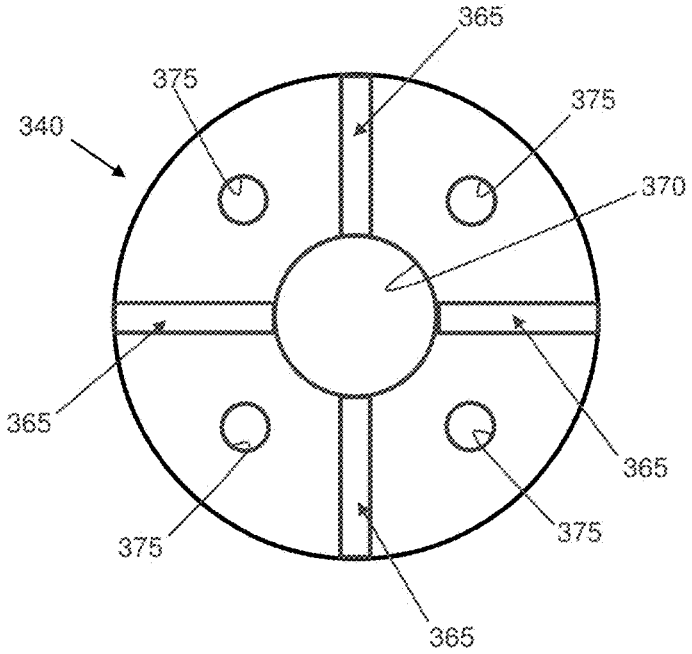

Looking next at FIGS. 20 and 21, dual-channel drill bit 340 comprises a proximal end 355 for mounting to the distal end 335 of dual-lumen drill rod 325, and a distal end 360 for engaging and drilling into the rock, as will hereinafter be discussed in further detail. Distal end 360 of dual-channel drill bit 340 comprises a plurality (e.g., four) of teeth 365 for engaging rock, a debris removal lumen 370 fluidically connected to debris vacuum lumen 350 of dual lumen drill rod 325, and a plurality (e.g., four) of compressed air exit ports 375 fluidically connected to pressurized air lumen 345 of dual lumen drill rod 325. In use, pressurized air is passed through pressurized air lumen 345 of dual lumen drill rod 325, and out through air exit ports 375 of dual-channel drill bit 340 while a vacuum is applied to debris vacuum lumen 350 so as to draw debris into debris removal lumen 370 of dual-channel drill bit 340 to remove debris from the hole, as will hereinafter be discussed in further detail.

Figure 22:
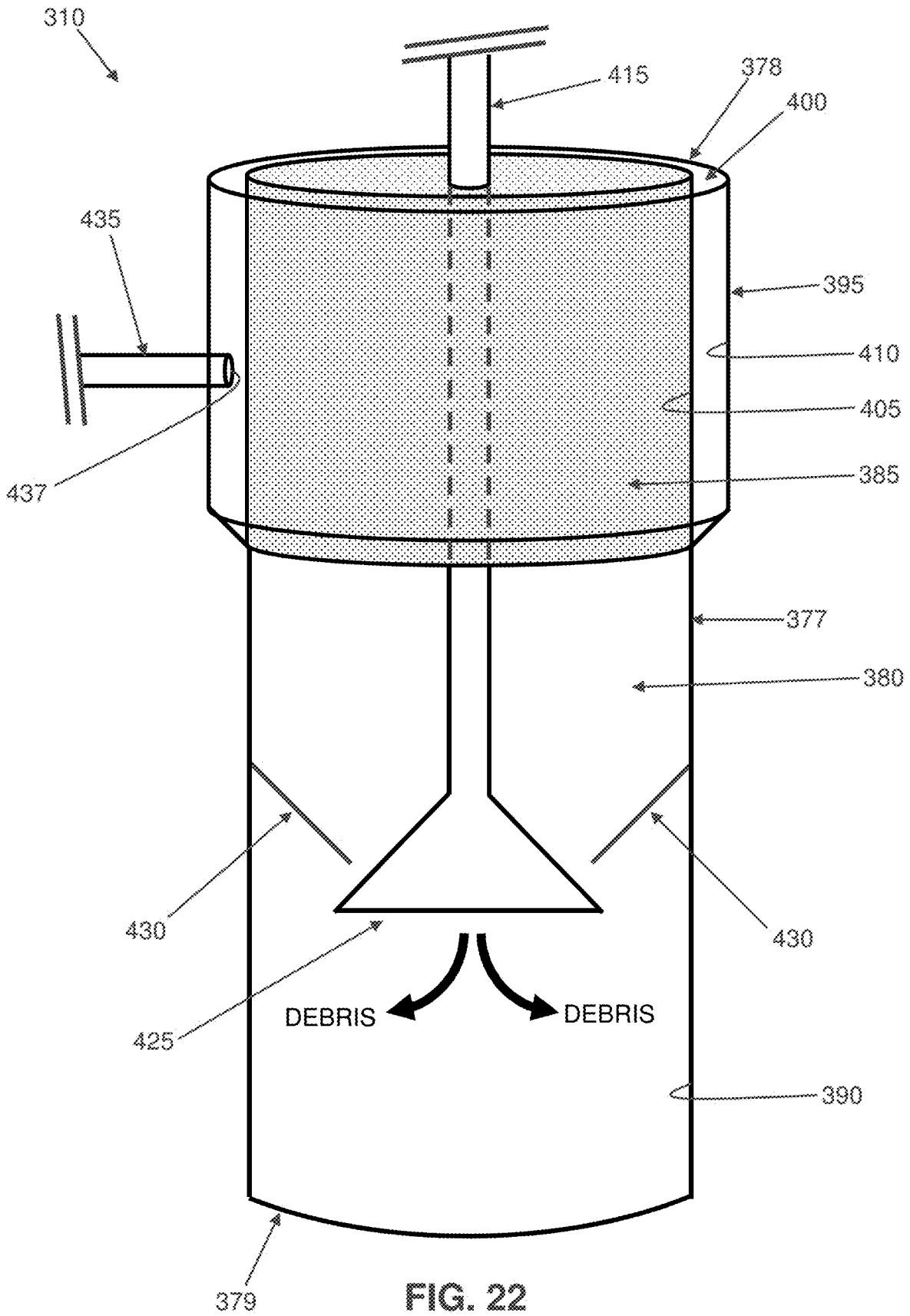
FIG. 22 is a schematic view showing a novel separator tank formed in accordance with the present invention.

Looking next at FIGS. 18 and 22, separator tank 310 preferably comprises a cylindrical side wall 377 enclosing a chamber 380, a top cap 378 for fluidically sealing the top (i.e., proximal) end of separator tank 310, and a bottom cap 379 for fluidically sealing the bottom (i.e., distal) end of separator tank 310. Cylindrical side wall 377 is divided into an upper portion 385 and a lower portion 390. Upper portion 385 comprises a radially-extending enlargement 395 which extends radially outboard of cylindrical side wall 377 such that a radially-extending gap 400 exists between the portion of cylindrical side wall 377 (indicated at 405) of upper portion 385 of separator tank 310 and the cylindrical side wall 410 of radially-extending enlargement 395. The portion of cylindrical side wall 377 (indicated at 405) of upper portion 385 of separator tank 310 is preferably perforated (e.g., formed as a screen), such that gap 400 is fluidically connected to the interior chamber 380.

A debris inlet pipe 415 having one end fluidically connected to debris vacuum lumen 350 of dual-lumen drill rod and the other end terminating in an open mouth 425, passes through a top cap 378 such that open mouth 425 is disposed intermediate chamber 380. One or more baffles 430 mounted to the inside wall of chamber 380 are preferably disposed proximal to mouth 425.

An air intake pipe 435 having an open end 437 passes through cylindrical side wall 410 of enlargement 395 and opens on gap 400 such that open end 437 of air intake pipe 435 is fluidically connected to gap 400.

In a preferred form of the invention, separator tank 310 comprises a hingedly-mounted hatch 440 (FIG. 18) formed in bottom cap 379 of separator tank 310 at the distal end (i.e., the "bottom") of separator tank 310. Hatch 440 is configured to permit selective opening of chamber 380 so as to permit removal of debris contained therein, as will hereinafter be discussed in further detail.

And in a preferred form of the invention, a hydraulic fluid line 445 (FIG. 18) is wrapped around (or formed integral with) a portion (or the entirety) of separator tank 310. Hydraulic fluid line 445 is preferably welded to (or formed integral with) the outer wall of separator tank 310 so as to facilitate efficient heat transfer from hydraulic fluid line 445 to separator tank 310, whereby to help keep the contents (e.g., debris) of separator tank 310 from freezing (e.g., into a solid mass that can be difficult to remove from separator tank 310) when novel debris removal system 300 is employed in cold environments. Hydraulic fluid line 445 is preferably connected to a hydraulic fluid source that is heated during operation of novel debris removal system 300. By way of example but not limitation, hydraulic fluid line 445 may be connected to drill drive element 320. Alternatively and/or additionally, hydraulic fluid line 445 may be connected to an excavator carrying novel debris removal system 300 and/or to any other hydraulic fluid source, as will be apparent to one skilled in the art in view of the present disclosure.

Looking now at FIG. 18, air handling system 315 preferably comprises an air compressor 450 and a filter 455. Compressor 450 comprises an inlet pipe 460 fluidically connected to filter 455, which is in turn fluidically connected to air inlet pipe 435. Compressor 450 also comprises an outlet pipe 465 which is fluidically connected to pressurized air lumen 345 of dual-channel drill bit 340. If desired, compressor 450 may further comprise an air tank (not shown) for storing compressed air.

It will be appreciated that, as a result of the foregoing construction, compressor 450 may be operated so as to force pressurized air through outlet pipe 465, through pressurized air lumen 345 of dual-lumen drill rod 325, through air exit ports 375 of dual-channel drill bit 340 into a drill hole during the action of drilling, into debris vacuum lumen 350 of dual-channel drill bit 340, through debris vacuum lumen 350 of dual-channel drill bit 340, through debris inlet pipe 415 and into the interior of chamber 380, whereupon the air is drawn through the perforations formed in the wall 405 of upper portion 385 of separator tank 310 and into gap 400. The air is then drawn from gap 400, through air intake pipe 435, through filter 455, and back into compressor 450 via inlet pipe 460.

Thus, novel debris removal system 300 comprises a generally closed system, wherein debris is removed from the drill hole and stored in a container (i.e., chamber 380 of separator tank 310) for removal while the air used to remove debris from the drill hole is filtered and recirculated, thereby avoiding potentially hazardous aerosolization of debris at the work site.

When it is desired to empty debris from chamber 380 of separator tank 310 (e.g., because chamber 380 is full, because drilling has concluded, etc.), hatch 440 may be opened (e.g., manually, by releasing an electronic locking mechanism, etc.), and debris falls out of chamber 380 of separator tank 310 (i.e., due to gravity) into a pre-positioned receptacle (e.g., a dump truck, wheelbarrow, etc.). Alternatively and/or additionally, hatch 410 may be configured to open automatically, e.g., when chamber 380 is full, when drilling has concluded, when the drill has been retracted, etc. To this end, hatch 410 may be outfitted with a photoelectric switch, a magnetic switch, etc., as will be appreciated by one skilled in the art in view of the present disclosure.

It should be appreciated that novel debris removal system 300 may be incorporated into the novel rock splitting apparatus 5 discussed above. By way of example but not limitation, the aforementioned novel rock splitting apparatus 5 may be modified to incorporate drill assembly 305, separator tank 310, and/or air handling system 315, all of which may be mounted to, or contained within, the aforementioned housing 25. In this manner, novel debris removal system may be entirely integrated with novel rock splitting apparatus 5.

Alternatively, novel debris removal system 300 may be used with substantially any drilling assembly used to drill a hole in rock (or other material). By way of example but not limitation, novel debris removal system 300 may be used with a conventional drilling rig, and may be mounted to a machine or support carrying the drilling rig (e.g., to an excavator), or may comprise a separate piece of equipment. And it should be appreciated that debris inlet pipe 415 and/or outlet pipe 465 may be extended as necessary such that separator tank 310 and/or air handling system 315 can be located at a distance from where drilling is performed.

MODIFICATIONS

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. A system for removing debris from a drill hole, said system comprising:

a drill system comprising:

a drill rod comprising a proximal end, a distal end, a first lumen extending between said proximal end and said distal end, and a second lumen extending parallel to said first lumen, said first lumen being fluidically-isolated from said second lumen;

a drill bit, said drill bit comprising:

a proximal end for mounting to said distal end of said drill rod;

a distal end configured to drill into a material so as to form the drill hole;

at least one air channel extending between said proximal end of said drill bit and said distal end of said drill bit, said at least one air channel being configured to be fluidically connected to said first lumen of said drill rod when said drill bit is mounted to said drill rod;

at least one vacuum channel extending between said proximal end of said drill bit and said distal end of said drill bit, said at least one vacuum channel being configured to be fluidically connected to said second lumen of said drill rod when said drill bit is mounted to said drill rod;

a container fluidically connected to said second lumen of said drill rod;

a compressor, said compressor being fluidically connected to said first lumen of said drill rod and fluidically connected to said container;

wherein said compressor (i) pumps pressurized air through said first lumen of said drill rod such that said pressurized air passes through said at least one air channel of said drill bit and exits said distal end of said drill bit into the drill hole, and (ii) pumps air out of said container so as to generate a vacuum within said container, which vacuum is fluidically connected to said second lumen of said drill rod and hence to said at least one vacuum channel of said drill bit, such that pressurized air exiting said at least one air channel into the hole and debris in the hole enters said at least one vacuum channel, passes through said second lumen of said drill rod and into said container, such that the debris is collected in said container;

wherein said container comprises a proximal end, a distal end, and a side wall extending therebetween so as to define a chamber;

wherein said side wall is a generally cylindrical side wall;

wherein said container comprises a radially-enlarged proximal end portion comprising a housing disposed over a portion of said generally cylindrical side wall so as to define a radially-enlarged, circumferentially-extending vacuum chamber between said housing and said side wall of said chamber, and further wherein said cylindrical side wall of said container comprises a plurality of openings fluidically connecting said chamber to said vacuum chamber.

2. A system according to claim 1 wherein said compressor is connected to said container through said side wall.

3. A system according to claim 1 wherein said distal end of said container comprises a hatch for selectively emptying the contents of said chamber.

4. A system according to claim 1 wherein said first lumen of said drill rod is disposed coaxial with said second lumen of said drill rod.

5. A system according to claim 1 wherein a debris pipe fluidically connects said second lumen of said drill rod to said container, and further wherein said debris pipe enters said container at the proximal end of said container.

6. A method for removing debris from a drill hole, said method comprising:

providing a drill system comprising:

a drill rod comprising a proximal end, a distal end, a first lumen extending between said proximal end and said distal end, and a second lumen extending parallel to said first lumen, said first lumen being fluidically-isolated from said second lumen;

a drill bit, said drill bit comprising:

a proximal end for mounting to said distal end of said drill rod;

a distal end configured to drill into a material so as to form the drill hole;

at least one air channel extending between said proximal end of said drill bit and said distal end of said drill bit, said at least one air channel being configured to be fluidically connected to said first lumen of said drill rod when said drill bit is mounted to said drill rod;

at least one vacuum channel extending between said proximal end of said drill bit and said distal end of said drill bit, said at least one vacuum channel being configured to be fluidically connected to said second lumen of said drill rod when said drill bit is mounted to said drill rod;

a container fluidically connected to said second lumen of said drill rod;

a compressor, said compressor being fluidically connected to said first lumen of said drill rod and fluidically connected to said container;

wherein said compressor (i) pumps pressurized air through said first lumen of said drill rod such that said pressurized air passes through said at least one air channel of said drill bit and exits said distal end of said drill bit into the drill hole, and (ii) pumps air out of said container so as to generate a vacuum within said container, which vacuum is fluidically connected to said second lumen of said drill rod and hence to said at least one vacuum channel of said drill bit, such that pressurized air exiting said at least one air channel into the hole and debris in the hole enters said at least one vacuum channel, passes through said second lumen of said drill rod and into said container, such that the debris is collected in said container;

wherein said container comprises a proximal end, a distal end, and a side wall extending therebetween so as to define a chamber;

wherein said side wall is a generally cylindrical side wall;

wherein said container comprises a radially-enlarged proximal end portion comprising a housing disposed over a portion of said generally cylindrical side wall so as to define a radially-enlarged, circumferentially-extending vacuum chamber between said housing and said side wall of said chamber, and further wherein said cylindrical side wall of said container comprises a plurality of openings fluidically connecting said chamber to said vacuum chamber;

rotating said drill bit so as to form a drill hole in a material; and passing pressurized air through said at least one air channel of said drill bit into the drill hole while simultaneously applying vacuum to said at least one vacuum channel so as to draw debris into said second lumen of said drill rod and into said container.

7. A method according to claim 6 wherein a debris pipe fluidically connects said second lumen of said drill rod to said container, and further wherein said debris pipe enters said container at the proximal end of said container.

8. A method according to claim 6 wherein said compressor is connected to said container through said side wall.

9. A method according to claim 6 wherein said distal end of said container comprises a hatch for selectively emptying the contents of said chamber.

10. A method according to claim 6 wherein said first lumen of said drill rod is disposed coaxial with said second lumen of said drill rod.

11. A system for removing debris from a drill hole, said system comprising:

a drill system comprising:

a drill rod comprising a proximal end, a distal end, a first lumen extending between said proximal end and said distal end, and a second lumen extending parallel to said first lumen, said first lumen being fluidically-isolated from said second lumen;

a drill bit, said drill bit comprising:

a proximal end for mounting to said distal end of said drill rod;

a distal end configured to drill into a material so as to form the drill hole;

at least one air channel extending between said proximal end of said drill bit and said distal end of said drill bit, said at least one air channel being configured to be fluidically connected to said first lumen of said drill rod when said drill bit is mounted to said drill rod;

at least one vacuum channel extending between said proximal end of said drill bit and said distal end of said drill bit, said at least one vacuum channel being configured to be fluidically connected to said second lumen of said drill rod when said drill bit is mounted to said drill rod;

a container fluidically connected to said second lumen of said drill rod;

a compressor, said compressor being fluidically connected to said first lumen of said drill rod and fluidically connected to said container;

wherein said compressor (i) pumps pressurized air through said first lumen of said drill rod such that said pressurized air passes through said at least one air channel of said drill bit and exits said distal end of said drill bit into the drill hole, and (ii) pumps air out of said container so as to generate a vacuum within said container, which vacuum is fluidically connected to said second lumen of said drill rod and hence to said at least one vacuum channel of said drill bit, such that pressurized air exiting said at least one air channel into the hole and debris in the hole enters said at least one vacuum channel, passes through said second lumen of said drill rod and into said container, such that the debris is collected in said container;

wherein said container comprises a proximal end, a distal end, and a side wall extending therebetween so as to define a chamber;

wherein said system further comprises a hydraulic fluid line contacting at least a portion of said side wall, whereby to transfer heat from said hydraulic fluid line to said chamber.

* * * * *